US012385193B2

(12) United States Patent
Koudstaal et al.

(10) Patent No.: US 12,385,193 B2
(45) Date of Patent: Aug. 12, 2025

(54) SYSTEM AND A METHOD FOR BUILDING A ROAD

(71) Applicant: Wavin B.V., Zwolle (NL)

(72) Inventors: Anne Cornelis Pieter Koudstaal, Ameide (NL); Simon Jorritsma, Nijkerk (NL); Antonie Twan Boshove, Kloosterhaar (NL); Harm Jantinus Marcel Jager, Westerhaar (NL)

(73) Assignee: PR LICENSING B.V., NL Vianen (NL)

( * ) Notice: Subject to any disclaimer, the term of this patent is extended or adjusted under 35 U.S.C. 154(b) by 145 days.

(21) Appl. No.: 17/263,866

(22) PCT Filed: Jul. 24, 2019

(86) PCT No.: PCT/NL2019/050476
§ 371 (c)(1),
(2) Date: Jan. 27, 2021

(87) PCT Pub. No.: WO2020/022888
PCT Pub. Date: Jan. 30, 2020

(65) Prior Publication Data

US 2021/0310200 A1 Oct. 7, 2021

(30) Foreign Application Priority Data

Jul. 27, 2018 (NL) ..... 2021404

(51) Int. Cl.
*E01C 11/22* (2006.01)
*E01C 5/00* (2006.01)
*E01C 5/20* (2006.01)

(52) U.S. Cl.
CPC ..... *E01C 11/227* (2013.01); *E01C 5/001* (2013.01); *E01C 5/20* (2013.01); *E01C 5/005* (2013.01)

(58) Field of Classification Search
CPC . E01C 5/001; E01C 5/005; E01C 5/20; E01C 11/227
(Continued)

(56) References Cited

U.S. PATENT DOCUMENTS 5,483,716 A * 1/1996 Burnaman ..... E04G 19/00 249/192
5,863,148 A * 1/1999 Shivaram ..... E01C 5/105 404/71
(Continued)

FOREIGN PATENT DOCUMENTS

DE 10 2006 031 789 A1 1/2008
FR 2 917 384 A1 12/2008
(Continued)

OTHER PUBLICATIONS

International Search Report and Written Opinion for International Application No. PCT/NL2019/050476, dated Oct. 16, 2019.
(Continued)

*Primary Examiner* — Raymond W Addie
(74) *Attorney, Agent, or Firm* — Joseph T. Leone; DeWitt LLP

(57) ABSTRACT

A system for assembling a road comprises a plurality of plastic support structures and a plurality of road deck elements. Each of the support structures comprises a base plate and at least one column extending, or for extending, upwardly from the base plate for supporting at least partly one of the road deck elements. Each of the road deck elements is configured such that in an assembled and as road useable condition of the system rainwater predominantly flows away over the road to one or more positions next to the road, and/or to a slit-sized interruption of the road across the road.

20 Claims, 22 Drawing Sheets

(58) Field of Classification Search
USPC ..... 404/17–31; 14/77.1
See application file for complete search history.

(56) References Cited

U.S. PATENT DOCUMENTS

| | | | | |
|---|---|---|---|---|
| 2002/0148186 | A1 | 10/2002 | Kasten | |
| 2008/0078038 | A1* | 4/2008 | Borazghi | E01D 19/125 14/73 |
| 2013/0152499 | A1 | 6/2013 | Kriekemeier | |
| 2014/0270944 | A1* | 9/2014 | White | E01C 19/52 404/27 |
| 2015/0284914 | A1* | 10/2015 | Gooden | E01C 9/005 404/43 |
| 2018/0030712 | A1 | 2/2018 | Kent et al. | |
| 2018/0259863 | A1* | 9/2018 | Komaki | G01D 5/28 |

FOREIGN PATENT DOCUMENTS

| | | | |
|---|---|---|---|
| WO | WO 2016/042141 | A1 | 3/2016 |
| WO | WO 2019/193041 | A | 10/2019 |

OTHER PUBLICATIONS

Ch. II International Preliminary Report on Patentability for International Application No. PCT/NL2019/050476, dated Jan. 26, 2021.

* cited by examiner

SYSTEM AND A METHOD FOR BUILDING A ROAD

RELATED APPLICATIONS

This application is a national stage filing under 35 U.S.C. § 371 of international patent application number PCT/NL2019/050476, filed Jul. 24, 2019, which claims priority to Dutch application number 2021404, filed Jul. 27, 2018. The entire contents of each of these applications is incorporated herein by reference in its entirety.

INTRODUCTION

The disclosure relates to a system for building a road, preferably comprising connectable elements and structures, even more preferably only comprising connectable elements and structures. The disclosure also relates to a method for building a road, preferably comprising connecting elements and structures, even more preferably only comprising connecting elements and structures.

BACKGROUND

Roads tend to be made by providing at least one continuous layer or at least one layer that contains a plurality of discrete parts which together form a layer. As a continuous layer, one could for instance think of a layer of asphalt. For a layer that contains a plurality of discrete parts which together form a layer one could think of natural or man-made ceramic blocks which each may have the same form and which can be laid in a pattern such that a continuous road deck is formed. It is also possible to have slabs of concrete adjacent each other. Such road decks are normally on a layer of sand, which in turn may be on a layer of granulate material. A road that is part of a bridge may be formed by a number of metal deck elements, held at a position by fixation to a support structure.

The use of support structures under road decks is not unique to bridges.

EP 1311727 discloses a structure having a plurality of layers supported by modules of which each comprises spaced apart parallel top and bottom layers joined by a peripheral sidewall defining an enclosed volume. A plurality of surface layers are disposed directly on top of the modules to provide a finished surface to support vehicular traffic. The modules are embedded in the ground and then covered by a number of layers. This may result in a way of making a road. However, that is a very cumbersome way.

EP 1469133 also describes a module that can be laid as a support structure under a road which would result in a similar cumbersome way of making a road.

Both of these prior art documents, foresee inflow of water directly at the top of the support structure, making rain water management dependent on the water permeability of the road layers on top of the support structures. The very same is true for WO 2018/083346 A1, which discloses grid boxes arranged next to each other, supporting together at least one layer of grid bodies in which grass and/or plants can grow and over which vehicular traffic can drive.

It is an object of the present disclosure to provide a system for building a road that addresses at least one of the above shortcomings.

SUMMARY OF THE DISCLOSURE

Provided is a system for assembling a road. In an embodiment, the system comprising a plurality of plastic support structures and a plurality of road deck elements. Each of the support structures comprises a base plate and at least one column extending, or for extending, upwardly from the base plate for supporting at least partly one of the road deck elements. Each of the road deck elements is configured such that in an assembled and as road useable condition of the system rainwater predominantly flows away over the road to one or more positions next to the road and/or to a slit-sized interruption of the road across the road. This embodiment of the system allows for an easy way of building a road, of which rainwater flows away in a sophisticated manner with much less dependency on the permeability of the road deck for water. Hence, water that falls on the road will not collect on the road where permeability of the road deck is poor. Instead, water may swiftly flow away from the road deck, therewith reducing splashing of water, reducing slipping due to water etc., and overall enhancing safety with regard to traffic over the road.

In an embodiment, the support structures and/or the road deck elements are connectable such that in an assembled condition at least one tunnel is formed between the road decks and the base plates. In an assembled condition of the system a road is formed and the least one tunnel then extends in a length dimension of the road. The length dimension may extend into the direction of the road. This allows for use of the tunnel for inspection purposes, using for instance a camera mounted on a dedicated mobile device that can find its way through the tunnel. This also allows for laying pipes and or cables through the tunnel for infrastructural purposes, not only related to for instance sewage and/or the need to provide electricity to lampposts, but also for providing the necessary cabling to and from induction coils that may in the future be embedded in the road for charging electrically driven automobiles. Not only can a road be easily assembled using the system, a road once laid using the system can also easily be opened up for maintenance of the components and networks placed under the road decks and/or for introducing new devices under the road deck.

As such activities can easily be carried out, relatively little planning is required and relatively short interruptions of the flow of traffic over the road will need to take place.

In an embodiment, at least a number of the support structures are free from having along the entire circumference of the base plate upwardly extending wall members extending in a direction parallel to the at least one column. Accordingly, the sides which are free from such wall members can be connected up for forming a tunnel as referred to above.

In an embodiment, for at least one and preferably each support structure it applies that the at least one column has a first end that has a seamless connection with the base plate or is connectable with the base plate. This allows for a very fast way of assembling, and for a very stable support structure. Use may for instance be made of a water infiltration element, commercially provided by the applicant under the trade-name "QBic plus" or "QBic+". These infiltration elements are described in WO2016/042141 A1. These elements may be turned upside down so that a base plate is immediately available and the ends of the columns are available for supporting at least one of the road deck elements. It is of course also possible that the columns are in an unassembled condition unconnected with the base plate, but connectable with the base plate.

In an embodiment, for at least one and preferably each support structure it applies that the at least one column has a second end that has a seamless connection with a carrier plate or is connectable with a carrier plate for carrying in an assembled condition of the system one or more adjacently placed road deck elements. This allows for using the infiltration unit as described in WO2016/042141 A1 in the position in which it has been envisaged for its use as an infiltration unit. Again it is possible that the columns are in an unassembled condition unconnected but connectable.

In an embodiment, the system comprises a carrier plate that has a seamless connection with at least two columns. The infiltration unit as described in WO2016/042141 A1 has, when used as described, such a carrier plate, and has the columns connected with the carrier plate. It is not inconceivable that the columns are provided as connectable to the carrier plate.

In an embodiment, the system comprises a carrier plate that is connectable with at least two columns. The infiltration unit as described in WO2016/042141 A1 allows, when used in an upside down fashion, for such a carrier plate to be connected with at least two columns which may each be part of mutually different support structures. The carrier plate may also be referred to as a connector plate.

In an embodiment, at least one of the plurality of support structures is at least partly usable as a water attenuation or water infiltration structure. Advantageously, the structure allows for the fast installation of a road of which rainwater can easily flow away over the road deck and which has a further water management facility under the road deck, so that the water flown away from the road is not a burden on the ground next to the road. This also reduces the need for having water management structures such as water attenuation or water infiltration structure next to the road. Consequently, the "footprint" of the road can remain compact. This is particularly advantageous where space for traffic infrastructure is limited.

In an embodiment, the system comprises a number of gutter elements. These can collect water that flows away over the road to a position next to the road and/or to a slit-sized interruption of the road across the road. Preferably such gutter elements have an outlet into or directed to the water attenuation or water infiltration structures.

In an embodiment, at least one of the gutter elements is separately connectable to at least one of the road deck elements and/or to at least one of the support structures. However, it is also not inconceivable that at least one of the gutter elements is at least partly integrated in at least one of the support structures and/or at least one of the road deck elements. It is also possible that at least one of the gutter elements is at least partly integrated in, or connectable to, at least one of the columns.

The disclosure also relates to a method of assembling a road. In an embodiment, the method comprises providing a plurality of plastic support structures and a plurality of road deck elements, wherein each of the support structures comprises a base plate and at least one column. This embodiment of the method further comprises connecting at least one of the road deck elements with at least one of the plastic support structures so that a road module is formed having at least one road deck element and at least one plastic support structure. This embodiment of the method further comprises connecting adjacently placed plastic support structures and/or adjacently placed road deck elements. This allows for a fast way of providing a road. This is advantageous when traffic infrastructure needs to be implemented and be made available without blocking for a relatively long period a surrounding infrastructure. Further, implementing a road is simpler, requiring less skills. Parts of the road, such as the road modules, may be put together elsewhere, and swiftly "dropped" in place where the road needs to be constructed.

In an embodiment, the method comprises placing the support structures adjacent each other such that the support structures have, relative to the direction of gravity, the base plates at a relatively low position and each of the at least one column extending upwardly from a base plate. This embodiment of the method further comprises placing the plurality of road deck elements adjacent each other such that the road deck elements are supported by the adjacently placed support structures, and such that a road deck is formed by the adjacently placed road deck elements and supported by the columns. This allows for placement of, say, cables, pipes, etc. before the road decks are placed, so that such cables, pipes etc. end up between the road deck elements and the support structures. This allows for tight timing and completion of an infrastructure in a short space of time, reducing overall "downtime" of that part of a traffic infrastructure. Further, no place is required for first placing or even building road modules and lifting modules into their position of the road to be formed.

Further embodiments of such a method will be presented in a more detailed description of exemplary embodiments of both the system and the method wherein reference is made to a drawing in which.

In the drawing, like references refer to like parts.

Figure 1:
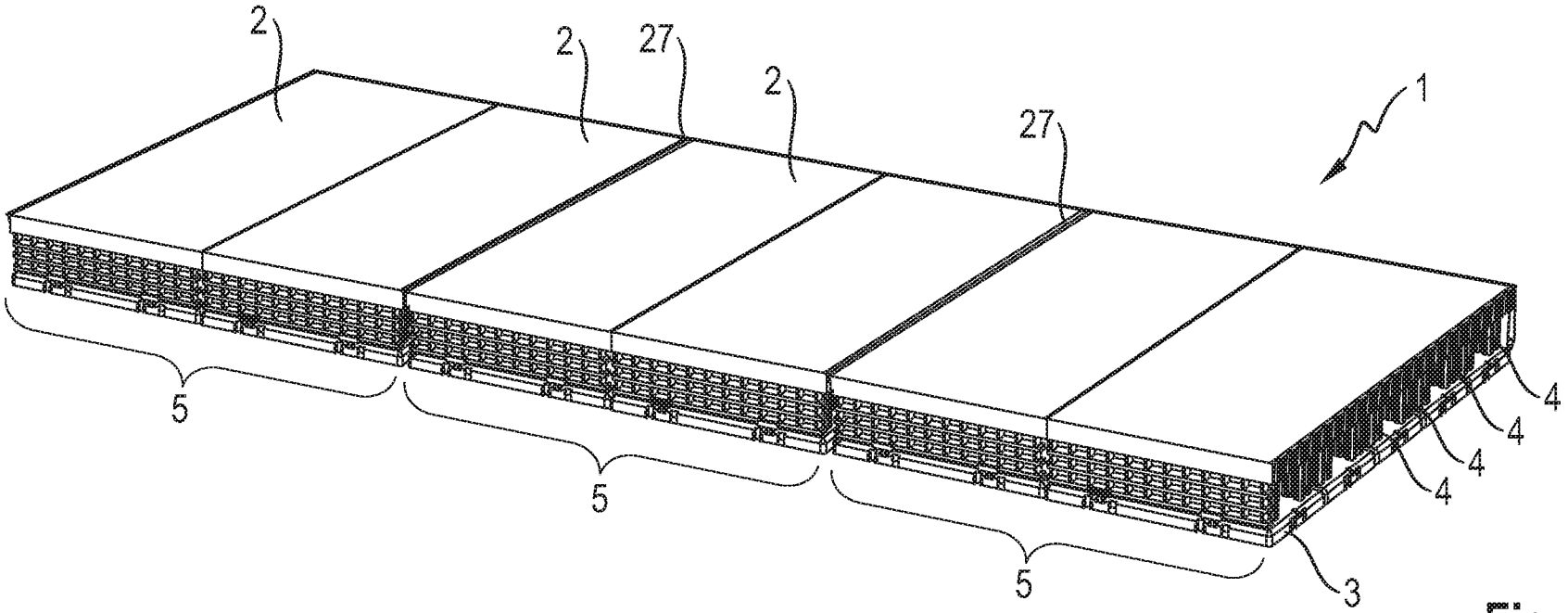
FIG. 1 shows in a perspective view an embodiment of a system according to the disclosure in an assembled and as road usable condition.

FIG. 1 shows a perspective view of a part of a plastic road 1. Normally, after assembling the system, the road will be embedded in the ground so that mainly the road deck is visible and available for traffic. The road deck is formed by a number of road deck elements 2. The system further comprises a plurality of plastic support structures 6 (see FIG. 4) which are normally, in use of the assembled system, embedded in the ground and not visible. The support structures 6 each comprise a base plate 3 and a number of columns 4 extending, or for extending, upwardly from the base plate 3. Each of the road deck elements 2 is configured such that in an assembled and as road usable condition of the system, rain water predominantly flows away over the road to one or more positions next to the road or to a slit-sized interruption of the road across the road. Such a configuration may entail a surface that predominantly guides water from any point on the surface over the surface toward an end of the road deck element and/or end of the deck modules which will be described below. Preferably such a surface is virtually free from drainage of water within the edges of the surface. The surface may be such that for a rainfall with a constant volume of rain per square centimeter for the entire surface, more than 50% of the water ends at a position next to the road deck. However, it is also possible that alternatively or additionally rainwater predominantly flows away over the road to a slit-sized interruption 27 of the road across the road. "Predominantly flowing over the road" is understood to mean "more flowing over the road than flowing into the road". In further optimized embodiments more than 70% flows over the road as opposed to through the road deck. A highly optimized embodiment allows for more than 90% of the water flowing over the road, as opposed to flowing through the road, or even more than 95%.

For the purpose of establishing whether rainwater predominantly flows over the road to one or more positions next to the road or to a slit-sized interruption of the road across the road, it is possible to use a test that simulates a rain pattern, for a road deck that includes an angle of 2° with the horizontal. For a rain density of 90 litres per sec per hectare a time of raining of 10 minutes and a road deck of 3 meters width and 3 meters length, and an angle included by the road deck surface with the horizontal of 2 degrees, more than 50% needs to be collected next to the road for qualifying as a road of which water predominantly flows over the road from the road. Of course, if "predominantly" means more than for instance 60%, then the same test setup can be used for measuring whether more than 60% flows off the road.

In this disclosure, it is assumed that the reader has in mind a direction of gravity as a result of references to a base plate and columns which extend upwardly from the base plate. That is, the base plate is referred to by referring to its use when the system is used in an assembled condition and usable as a road. The base plate can have the function of a base from which columns extend upwardly for supporting, clearly from underneath, road deck elements. Thus, whilst the base plate may in an assembled and as road usable condition of the system have a lower position (relative to the direction of gravity), the road deck will have a upper position. Accordingly, in an assembled and as road usable condition rain water comes down along the direction of gravity onto the road and will, somehow, follow the direction of gravity and try to find its way to a lower position. According to the present disclosure that rain water will predominantly flow over the road to a position next to it, or to a slit-sized interruption of the road across the road.

A system according to the present disclosure may in an assembled and in a road usable condition be positioned such that the base plate and the road decks are under a shallow angle with the horizontal. A typical angle would be between 1° and 3°, preferably around 2°.

Road deck 1 in FIG. 1 is formed by lining up a number of road deck modules 5.

Figure 2:
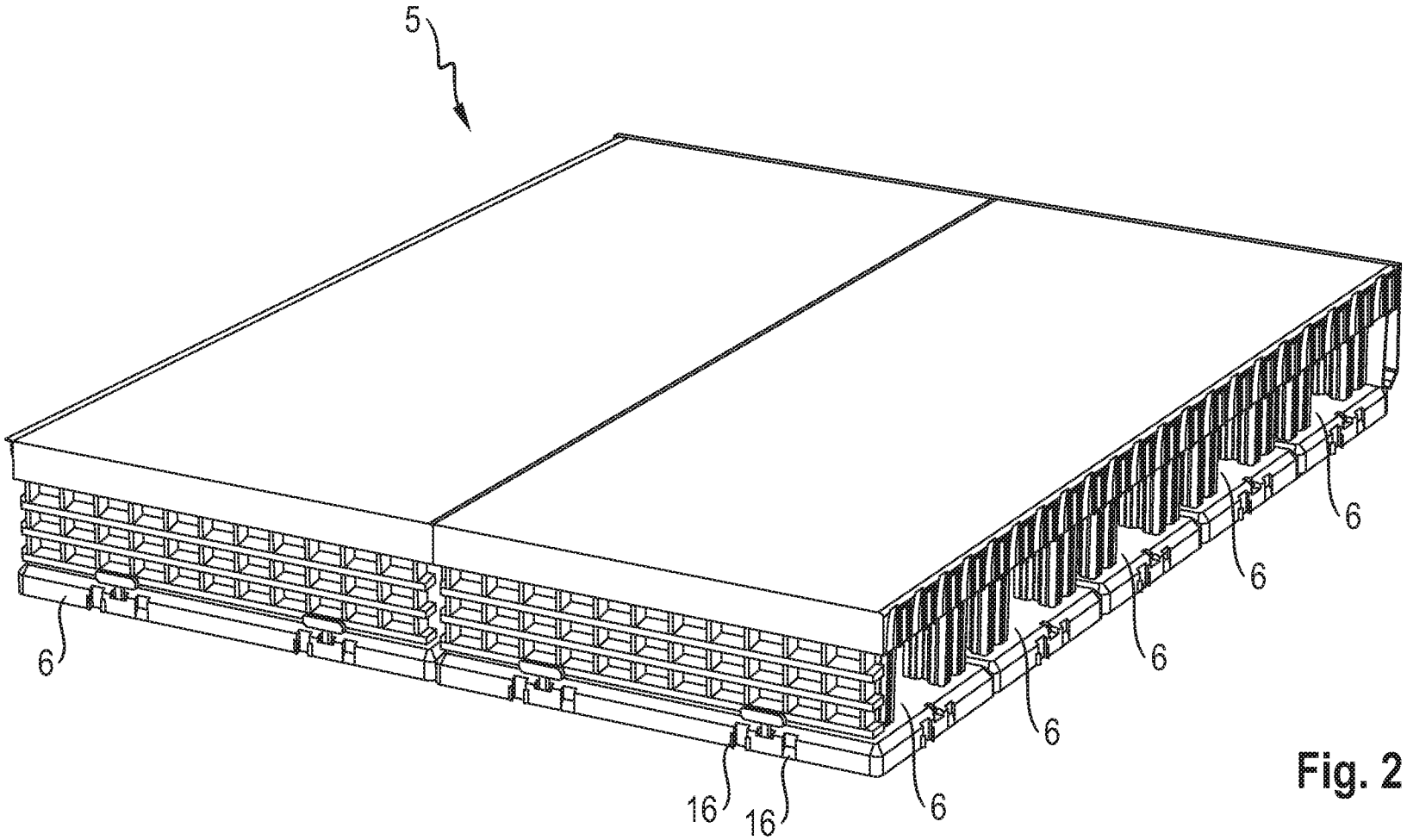
FIG. 2 shows in perspective a module of an embodiment of a system according to the disclosure.

FIG. 2 shows in more detail a road deck module 5 and the presence of support structures 6. This example of a road deck module 5 comprises ten support structures. See also FIGS. 9, 10 and 13. According to the present disclosure, each of the support structures 6 comprises a base plate 3 and at least one column 4 which extends upwardly from the base plate 3 for supporting at least partly one of the road deck elements 2. As will be seen later, in this example each support structure 6 has six columns 4 which together support one road deck element 2.

Figure 3:
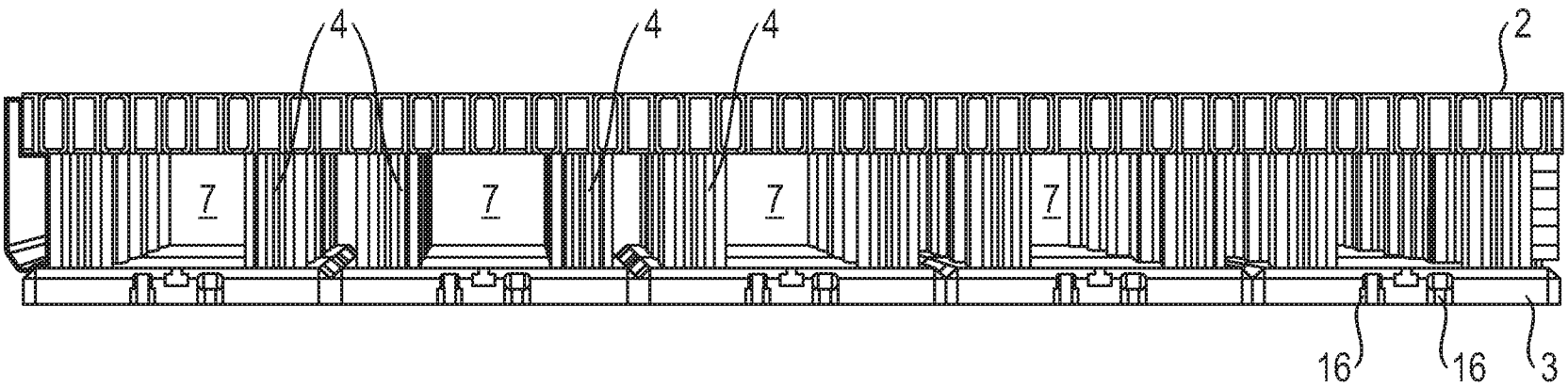
FIG. 3 shows a view through a module as shown in FIG. 2 in a direction of the direction of the road.

The support structures 6 and/or the road deck elements 2 are connectable such that in an assembled condition at least one tunnel 7 is formed between the road deck elements 2 and the base plates 3. In an assembled condition of the system, a road 1 is formed and at least one tunnel 7 extends in a length dimension of the road 1. FIG. 3 shows a view through a tunnel 7 in the road direction, i.e. in the direction of the road below the road deck elements 2 and the base plates 3.

Figure 4:
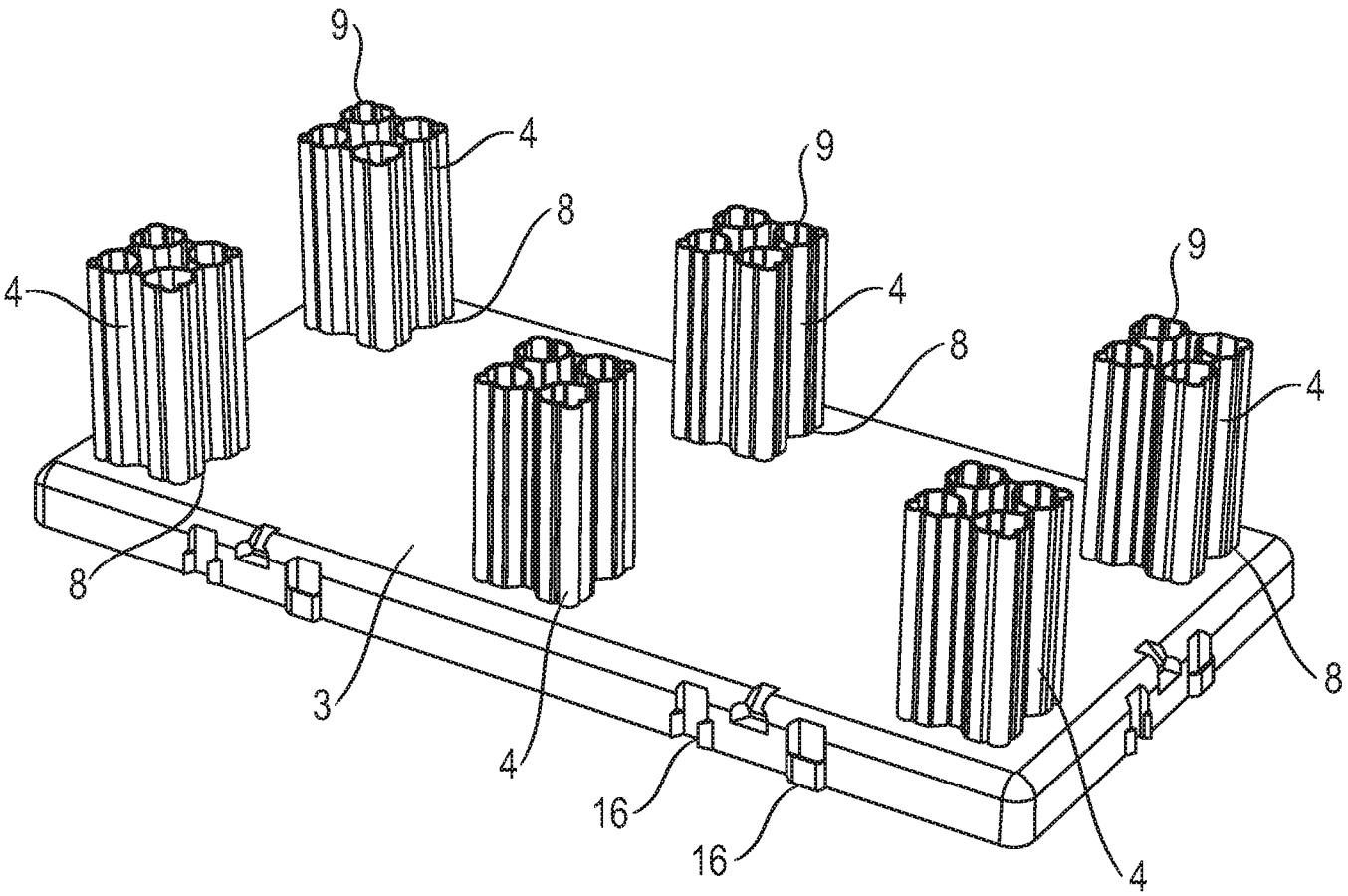
FIG. 4 shows a support structure of an embodiment of a system according to the disclosure.

An example of a support structure 6 is shown in FIG. 4. Such a support structure 6 is free from having along the entire circumference of the base plate 3 upwardly extending wall members extending in a direction parallel to the columns 4. This facilitates the forming of tunnel 7.

A very practical way of providing such a support structure 6 is by shortening the columns of a so-called Q-Bic+ module that is normally intended to form part of a storm water management system. These modules are commercially available from WAVIN and well described in WO 2016/042141 A1. The part which in the present disclosure is referred to as a base plate, is in the use as described in WO 2016/042141 A1 at an upper level of the Q-Bic+ module. For the use of the Q-Bic+ module in a system according to the present disclosure, the Q-Bic+ module may be turned upside down. As indicated above, the columns 4 are shortened relative to the columns of the presently commercially available Q-Bic+ module. Such shortening can be carried out by sawing in the thickness direction through the columns. For at least one and preferably each support structure 6 it then applies that the columns 4 at the first end 8 have a seamless connection with the base plate 3. It is also possible that the column has a first end 8 that is connectable with the base plate 3. Further, for at least one and preferably each support structure 6, the columns 4 have a second end 9 that may have a seamless connection with a carrier plate (not shown). In the embodiment shown in the present disclosure, each column has however a second end 9 that is connectable with a carrier plate. It needs to be borne in mind that the alternative in which the columns 4 have a seamless connection with a carrier plate, may correspond to use of a Q-Bic+ module in its orientation as intended in the storm water management system as promoted by WAVIN and described in WO 2016/042141 A1. Accordingly, it is thus possible that the system comprises a carrier plate 10 that has a seamless connection with, say, six columns 4 (using the Q-Bic+ module as intended in the storm water management system as promoted by Wavin) or that the carrier plate is connectable with six columns 4 as will be detailed further below.

Figure 5:
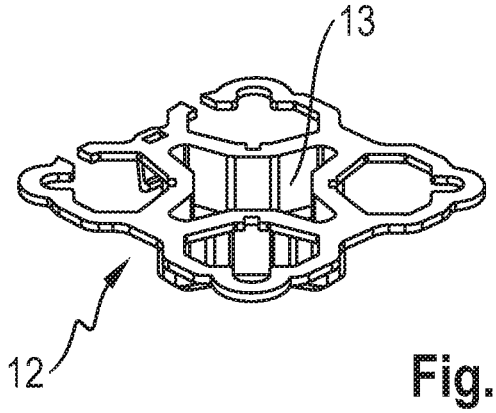
FIG. 5 shows a part of a connector part of an embodiment of a system according to the disclosure.
Figure 6:
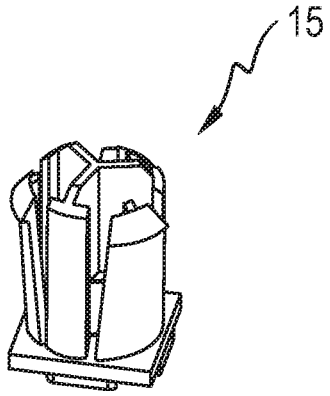
FIG. 6 shows a part of a connector part of an embodiment of a system according to the present disclosure.
Figure 7:
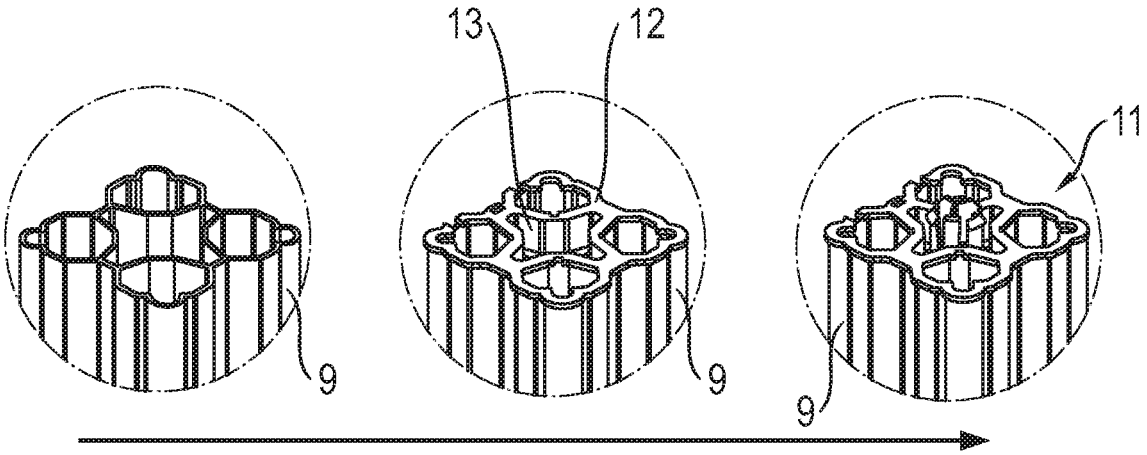
FIG. 7 shows schematically assembling of a connector part of an embodiment according to the present disclosure.

Preferably, at least one of the columns is provided with a connector part 11 for connecting with at a least part of one of the road deck elements 2, so that the respective road deck element is supported by at least one column 4. FIGS. 5, 6 and 7 show how the second end 9 of a column 4 may be adapted so that it has such a connector part 11. A rim part 12 having a central pocket 14 may be provided for inserting into the open end 9 of column 4 so that the rim of the column is broadened and a possibly rough cutting edge at the first end 9 of the column is covered by the rim part 12. The rim part 12 can be clicked into the hollow column 4, in the Q-Bic+ module as used for storm water management. The rim part 12 has in its center 13 the pocket 14 for housing a click element 15. Rim part 12 and click element 15 form together connector part 11. For obtaining swiftly an understanding of the interaction between second end 9 of column 4 and connector part 11, the reader is also referred to FIG. 18. Of course, many other ways of providing a connector part 11 are possible.

Figure 8:
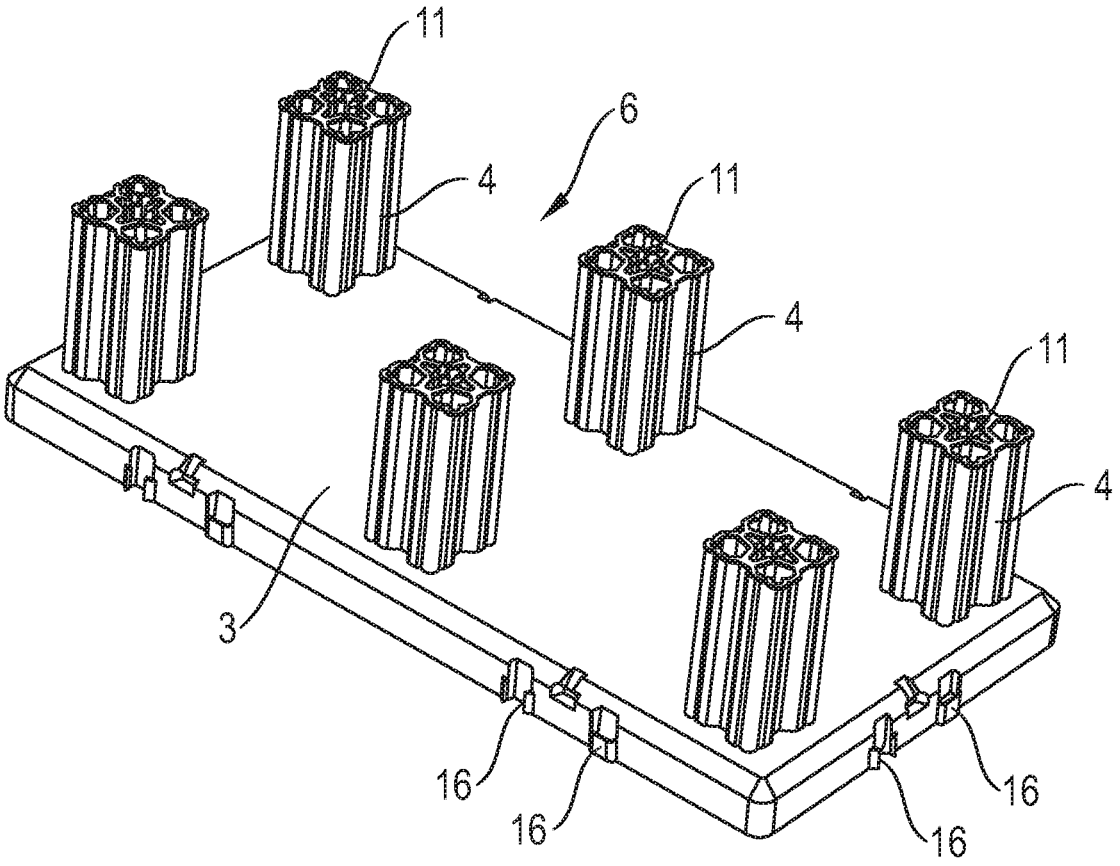
FIG. 8 shows a support structure of an embodiment of a system according to the present disclosure.

FIG. 8 shows a support structure 6 having a base plate 3 and six columns 4. Each of the columns 4 is provided with a connector part 11. It is possible to have a support structure 6 with only one column 4, although ideally more than one, and preferably six columns, extend from each base plate 3 upwardly.

Figure 9:
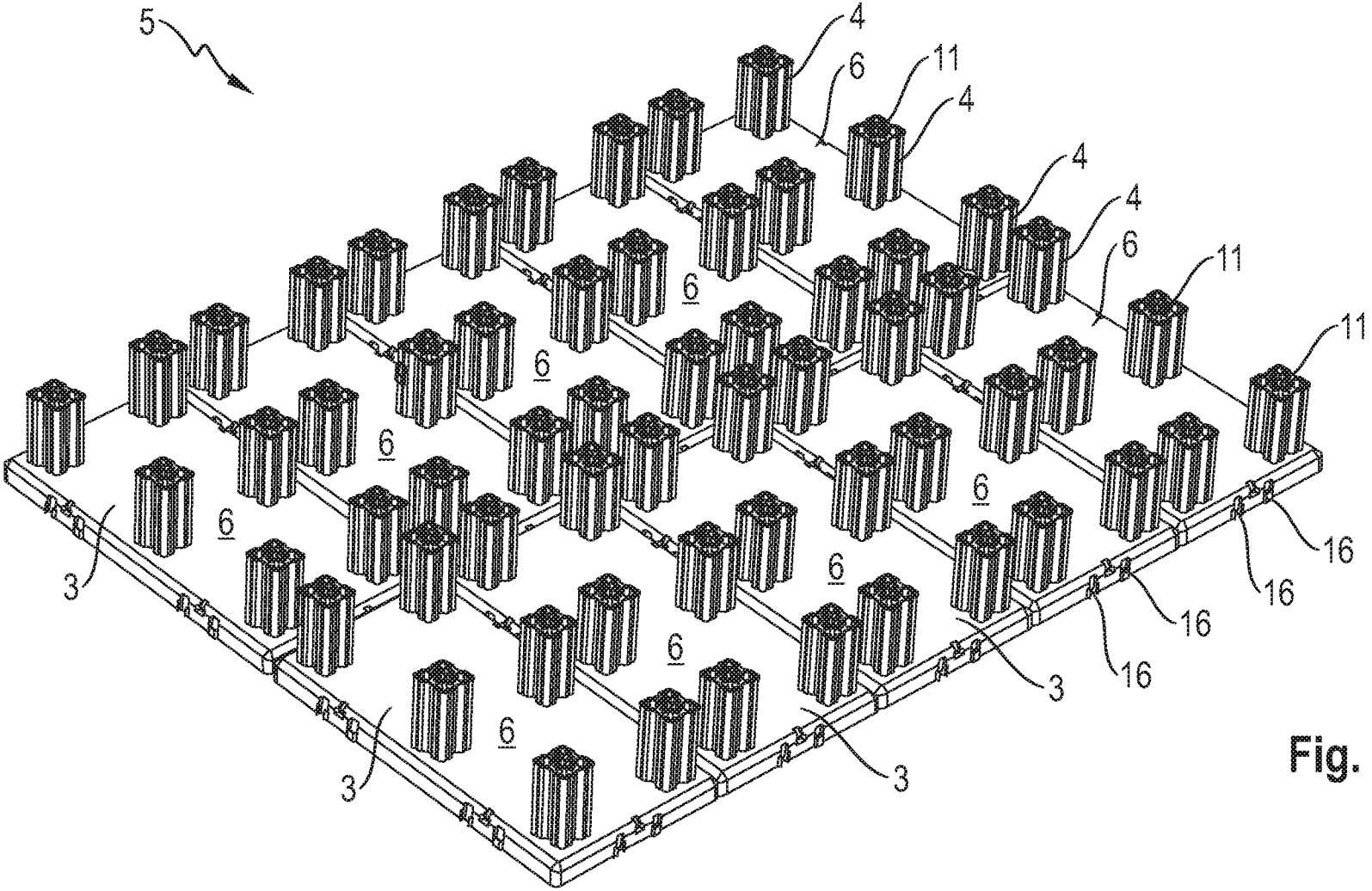
FIG. 9 shows a part of a road module according to an embodiment of a system according to the present disclosure.

FIG. 9 shows a part of a road deck module, comprising ten support structures 6 placed adjacent each other in a 2×5 configuration. The support structures have, relative to the direction of gravity, the base plates at a relatively low position and the columns extending upwardly from the base plate. The adjacently placed support structures are connected to each other. For this purpose, each base plate 3 is provided with connectors 16, for instance integrated, as further described in WO 2016/042141 A1.

Figure 10:
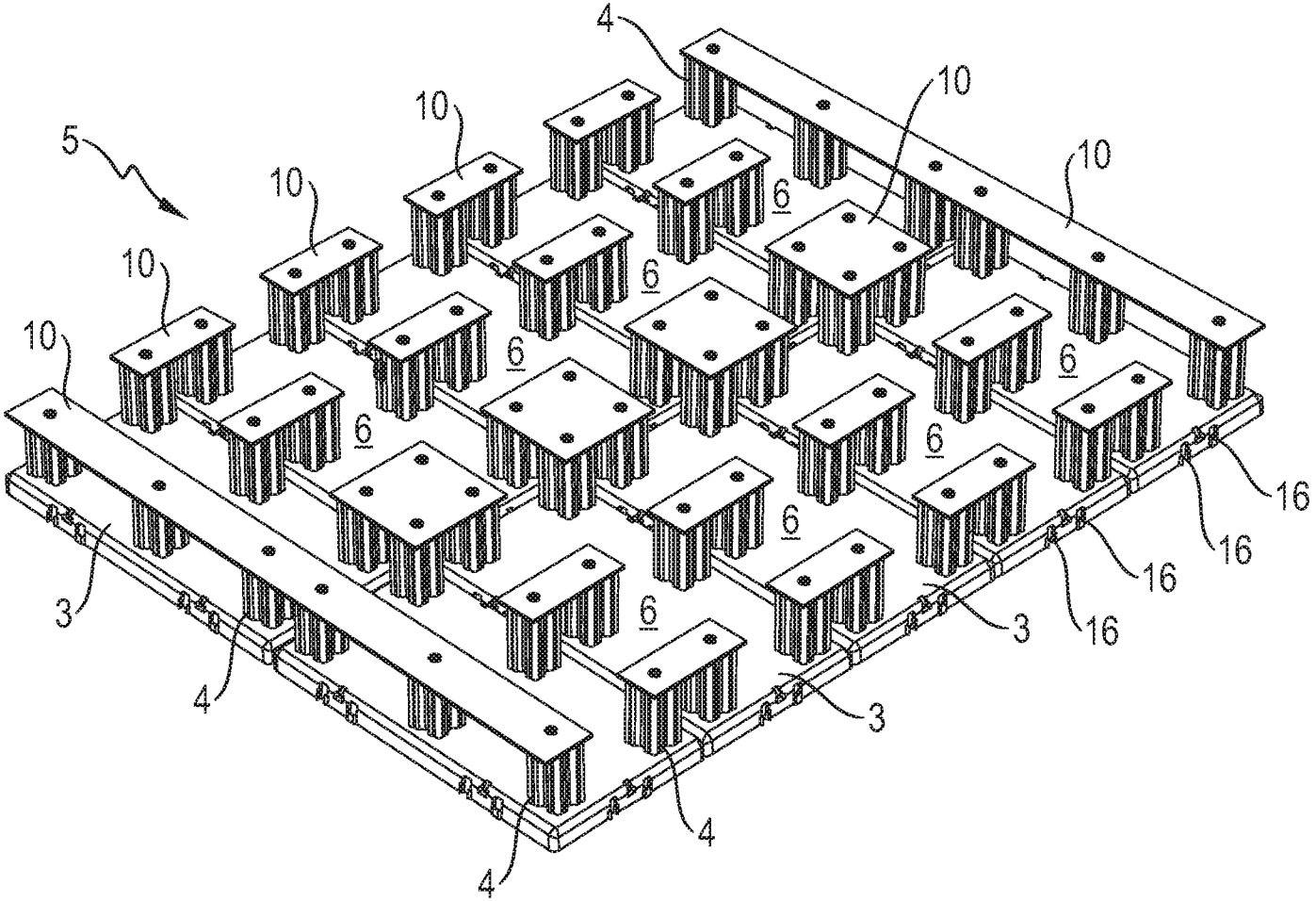
FIG. 10 shows a part of a road module of an embodiment of a system according to the present disclosure.

FIG. 10 shows a part of an embodiment of a road deck module 5 that is similar to the one shown in FIG. 9 but that has in addition carrier plates 10. Such carrier plates may also be referred to as connector plates 10, given that the plates in the example shown provide a further connection between individual support structures 6. Such plates 10 may be made of polypropylene (PP), preferably a recyclate, and possibly reinforced by glass fibers.

It should be borne in mind that carrier plates 10 not necessarily have the function of also connecting support structures. Carrier plates 10 do not even need to be connected to the columns. The carrier plates 10 may just rest on the columns and provide for transfer of load from the road decks 2 through the columns 4.

Figure 11:
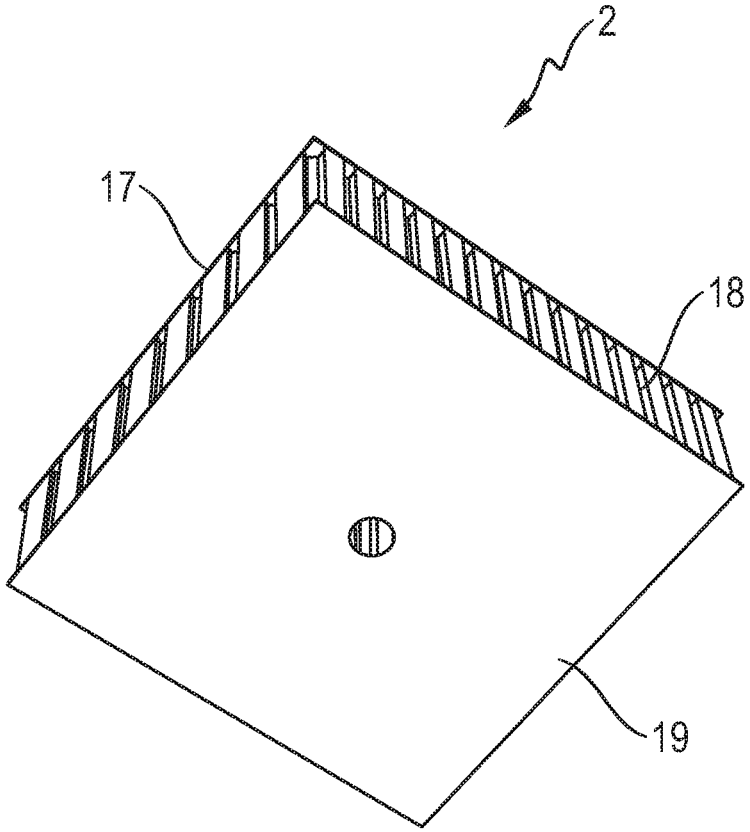
FIG. 11 shows a perspective view onto a part of a road deck element of an embodiment of a system according to the present disclosure.

FIG. 11 shows a part of a road deck element 2. In an embodiment, the road deck element 2 comprises plastic. Preferably, at least one, and preferably each, of the plurality of the road deck elements 2 comprises fibers, such as glass fibers, carbon fibers or even organic fibers as reinforcement. As can be seen in FIG. 11, the road deck element 2 may comprise a structure having a plate-shaped part 17 that forms in an assembled and as road usable condition an upper deck level 17 of the respective road deck element 2. Road deck element 2 may have a cell-structure part 18 as a lower deck level. The plate-shape part 17 may form the uppermost deck level. That plate-shaped part 17 may comprise a non-plastic, preferably a ceramic, material for providing a friction enhancing surface and/or for providing a wear resistant surface. As can be seen from FIG. 11, the road deck element 2 may comprise a sandwich structure, having the cell-structured part 18 between the plate-shaped part 17 that forms an upper deck level and a plate-shaped part 19 that is provided at a side of the cell-structured part 18 that is opposite the plate-shaped part 17 that forms the upper deck level. Although not shown in FIG. 11, these cell-structured parts 18 may comprise a honeycomb structure, such that the honeycomb has its axis directed toward the plate-shaped part 17 that forms an upper deck level of the respective road deck 102. Such sandwich structures are known for instance under the name Nidapan 8 GR 600 from Nidaplast in France.

Figure 12:
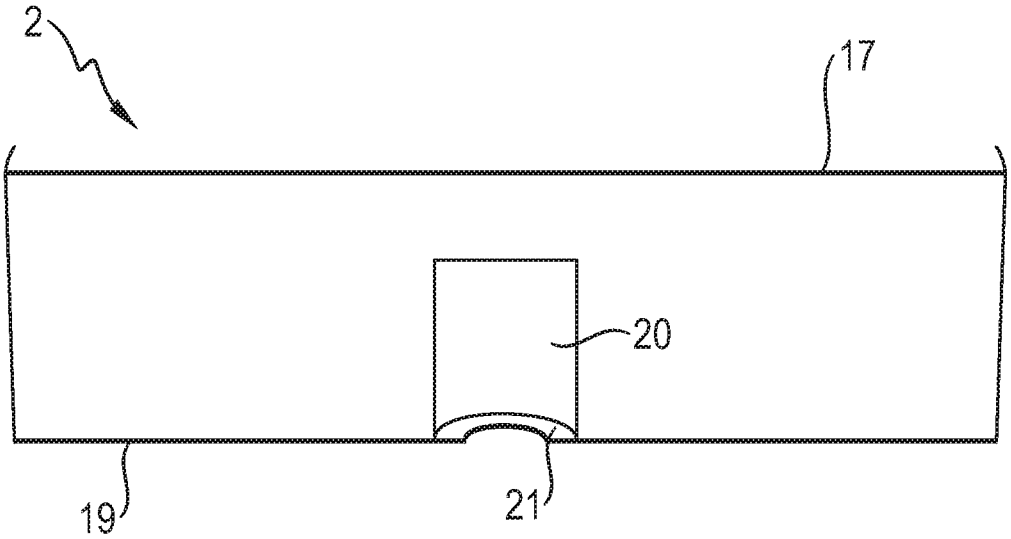
FIG. 12 shows a cross-sectional view onto a part of a road deck element as shown in FIG. 11.
Figure 18:
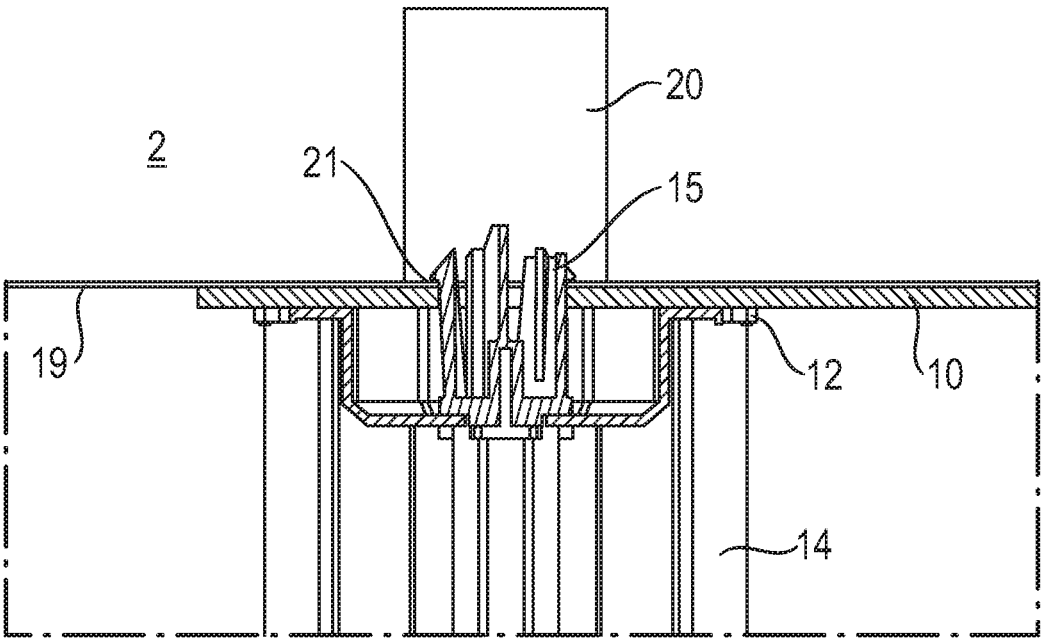
FIG. 18 shows a cross-sectional view of a column, a connector part, a carrier plate, and a road deck element of an embodiment of a system according to the present disclosure.

FIG. 12 shows a cross sectional view of a road deck element as shown in FIG. 11. The road deck element 2 has a chamber 20 for receiving an upper part of click element 15. The chamber 20 is positioned in the lower plate-shaped part 19 of the road deck element 2 at a position such that the road deck element 2 will properly fit according to a predetermined scheme onto a number of adjacently placed support structures having connector parts 11, so that the click elements 15 as provided on the second ends 9 of the columns 4 will each fit in a chamber 20. As can be seen in FIG. 12, chamber 20 is provided with a retainer rim 21 which allows for penetration of click element into chamber 20 and resistance against removal of click element 15 out of chamber 20. Reference is made to FIG. 18 for providing further understanding of the way click element 15 provided at the second end 9 of column 4 interacts with carrier plate 10, and chamber 20 of road deck element 12.

Figure 13:
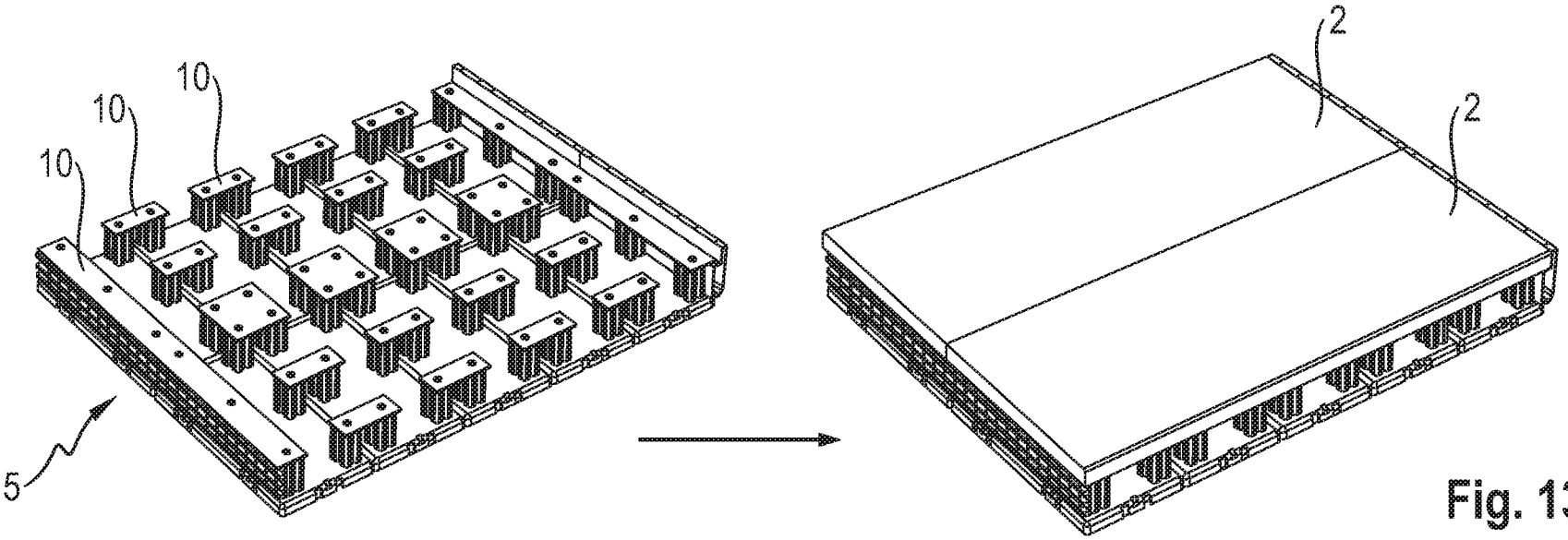
FIG. 13 shows a view onto a part of a road module before carrying out a step of a method for assembling a road and a view onto a road module after carrying out that step.
Figure 14:
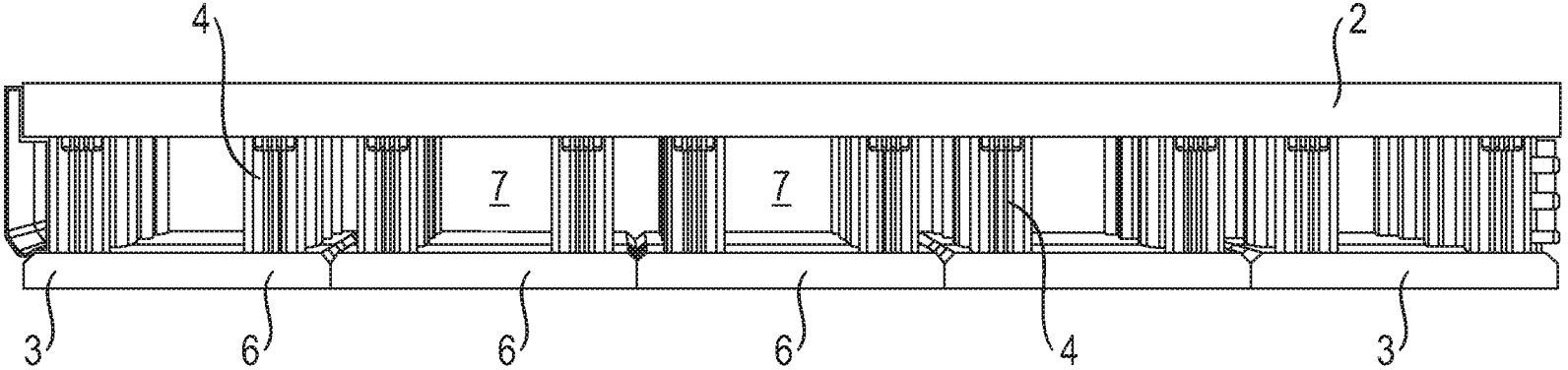
FIG. 14 shows a view in the direction of the road direction through a road module of an embodiment of a system according to the present disclosure.

FIG. 13 illustrates a part of the road deck module 5 before placing and connecting of road deck elements 2 as well as road deck module 5 after it has been provided with two adjacently placed road deck elements 2. FIG. 14 shows a view in the direction of the road. For the sake of clarity a number of elements, such as the integrated connector 16 are not shown in FIG. 14.

Figure 16:
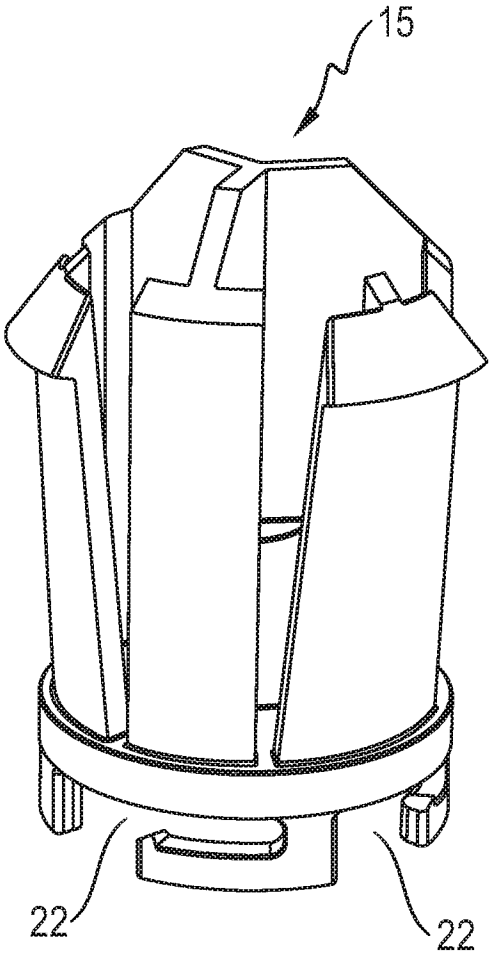
FIG. 16 shows a perspective view onto a part of a connector part of an embodiment of a system according to the present disclosure.
Figure 15:
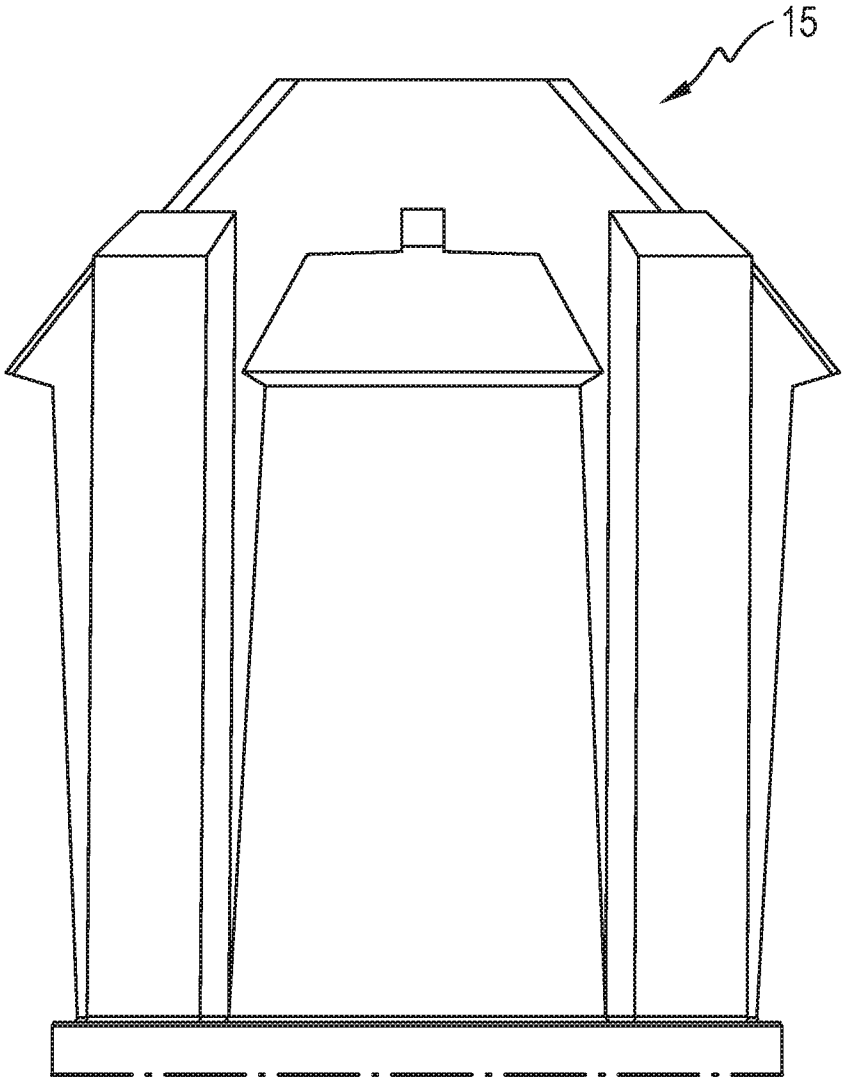
FIG. 15 shows a detailed view onto a part of a connector part of an embodiment of a system according to the invention.
Figure 17:
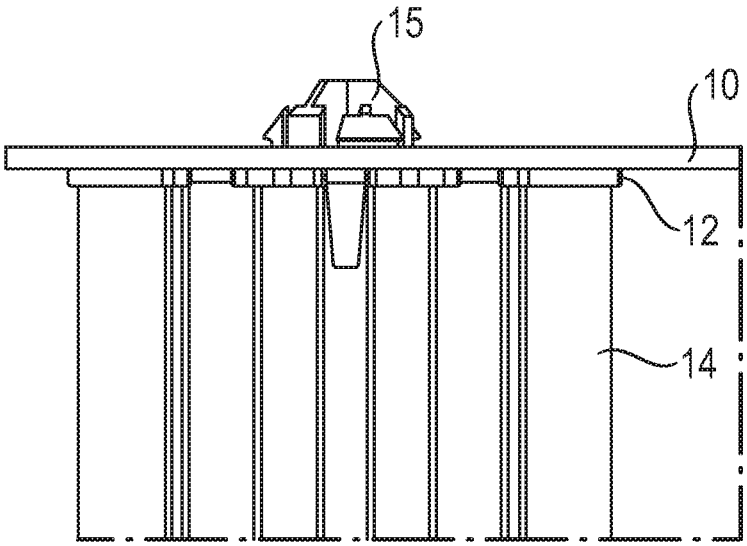
FIG. 17 shows a side view of a connector part as connected to column and extending through a carrier plate, all as part of an embodiment of a system according to the present disclosure.

For the sake of completeness, FIG. 15 shows in more detail a click element 15. A person skilled in the art will easily appreciate how this element is constructed and how it works. Also FIG. 16 shows a more detailed view onto such a click element 15 and reveals a bayonet-type of fixation mechanism 22 at a lower end of click element 15 for fixation of click element 15 at a counter part at the bottom of pocket 14. These features are well-known to a person skilled in the art. FIG. 17 reveals in a cross sectional view the interaction between the column 4, click element 15 and carrier plate 10. Further, FIG. 18 reveals in a cross sectional view the interaction between column 4, click element 15, rim part 12, carrier plate 10 and chamber 20 having retainer ring 21 as part of road deck element 2. So far, focus has been on the making of a road deck module 5. Before directing a focus on the further making of a road, attention is also paid to opening up a road deck module 5.

Figure 19:
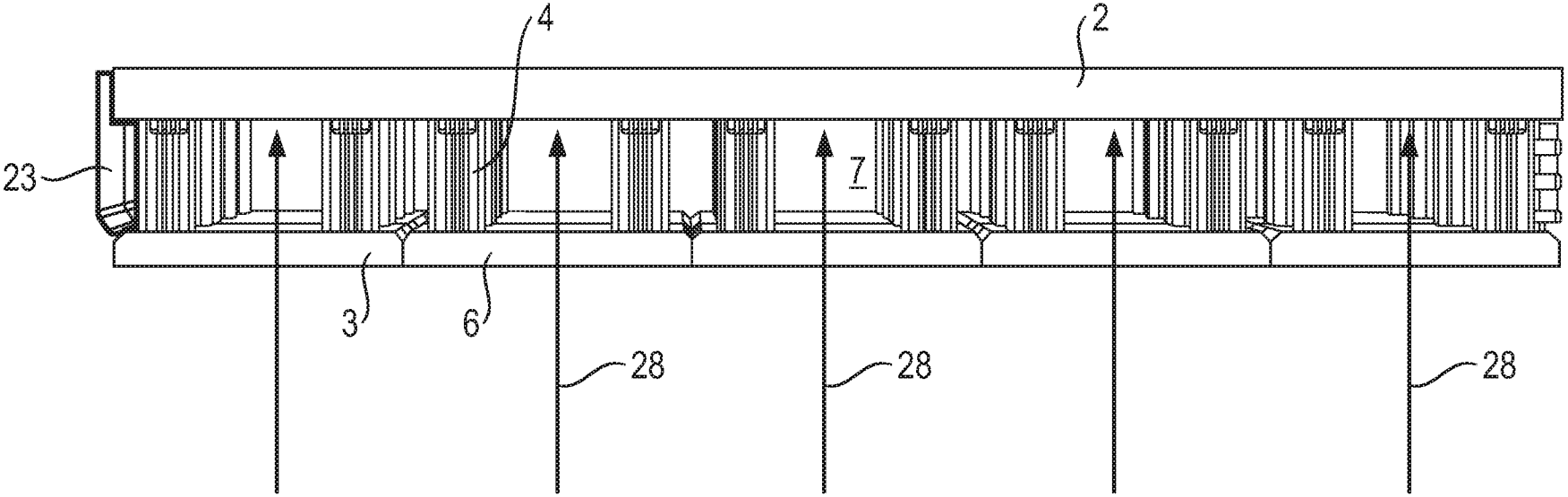
FIG. 19 shows schematically an indication as to how a road deck element can be removed from support structures of an embodiment of a system according to the present disclosure.

FIG. 19 shows schematically by means of arrows where force should be applied for disconnecting road deck element 2 from support structure 6. Arrows 28 indicate forces that need to be generated for lifting off road deck 2 from support structures 6. The forces can be mechanically generated forces, hydraulically generated forces or pneumatically generated forces. For instance, by means of using air inflatable packets placed at suitable positions within the road decks and accessible from a side of the road, a pneumatic force can be applied for lifting off a road deck from the columns.

As explained above, each road deck element 2 is provided with a connection side 19 that is at a side opposite the side having the outer layer 17 and is provided with a connection structure such as chamber 20 which are each releasably connectable with one of the connector parts 11.

Such disconnecting of road deck element 2 may be necessary when further other infrastructural elements such as pipes, cables or elements for charging up batteries of cars by means of induction, etc. need to be placed under the road deck.

Clearly, preferably at least one, and more preferably each of the road deck elements is configured for placement as a single element directly on top of one or more adjacently placed support structures 6. However, as explained, it is also possible that in between the support structures 6 and the road deck elements 2 so-called carrier plates or connector plates 10, may be present.

Figure 20:
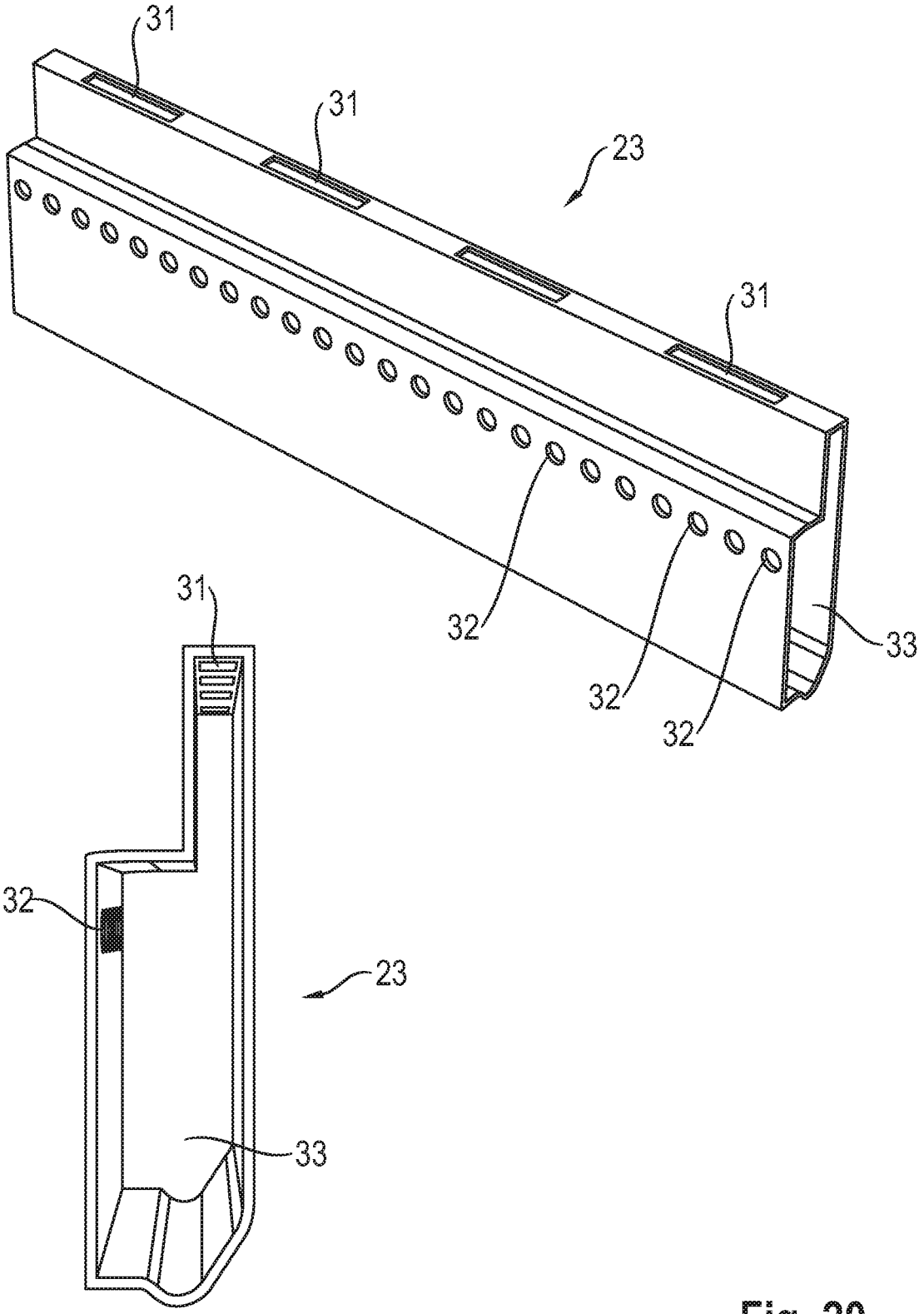
FIG. 20 shows in (a) a perspective view of a gutter element of an embodiment of a system according to the present disclosure and (b) a view through that gutter element in a longitudinal direction thereof.

The system may also comprise a gutter element 23 as shown in FIG. 20. In an upper part of the figure in a perspective view and in a lower part of the figure as seen from the view through a gutter element and along a longitudinal direction of such a gutter element 23. The gutter element 23 may be separately connectable to at least one of the road deck elements 2 and/or to at least one of the support structures 6. It is also possible that the gutter element 23 is at least partly integrated in at least one of the support structures 6 and/or at least one of the road deck elements 2. Such an integrated embodiment would of course require that the support structure 6 and/or the road deck elements 2 are asymmetric and therewith less versatile in their use. It is also conceivable that the gutter element 23 is at least partly integrated in, or connected to, one or more of the columns 4. For a more detailed description of the gutter element 23 and its possible interaction with the structure to which it is connected, reference is made to the Dutch patent application NL 1042809, as well as to PCT/EP2019/058382, incorporated herein by reference. The gutter element 23 has an inlet 31. In use that inlet 31 is next to the road. The gutter element 23 has an outlet 32. In use that outlet 32 is directed into the tunnel 7. A reservoir 23 can be filled up with water before water flows out of outlet 32.

Figure 21:
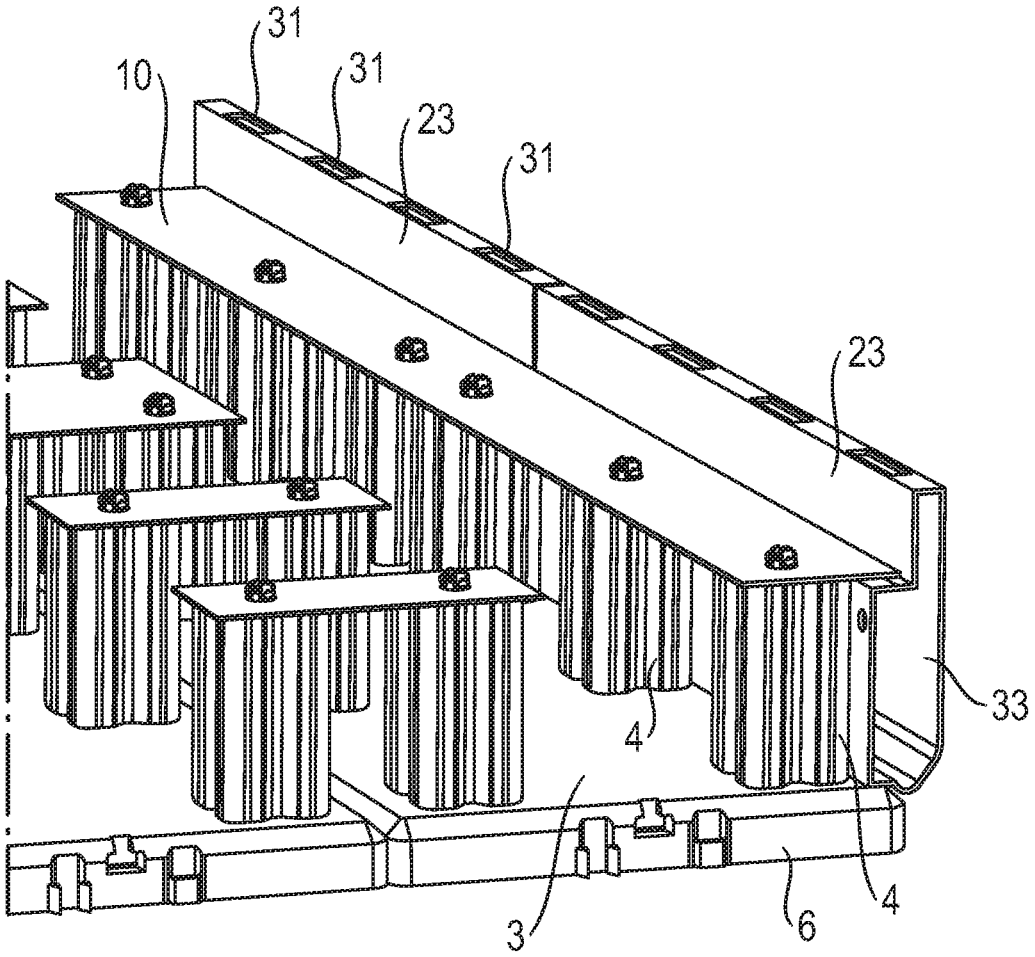
FIG. 21 shows in a perspective view the gutter element shown in FIG. 20, as connected as a part of a road module of an embodiment of a system according to the present disclosure.
Figure 22:
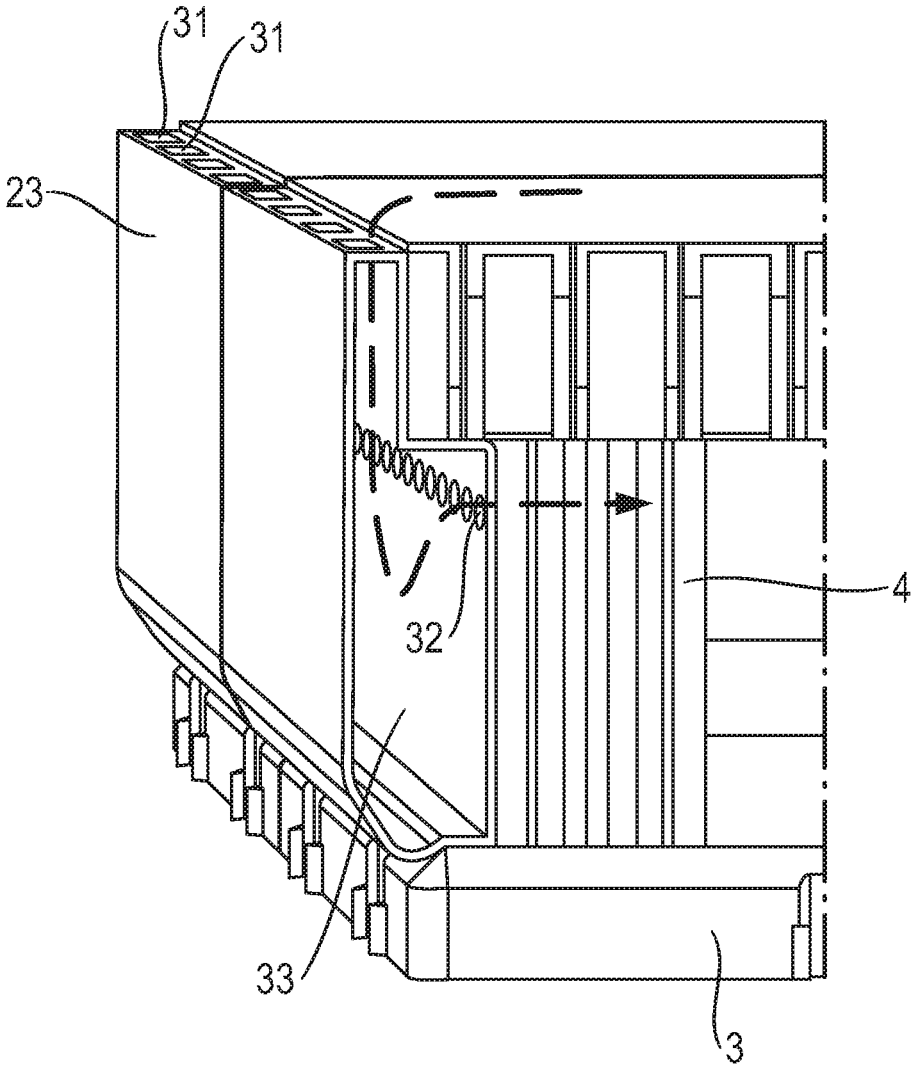
FIG. 22 shows schematically an indication as to how water can flow from a road deck into the gutter element and subsequently into a support structure under the road deck element as part of an embodiment of a system according to the present disclosure.

FIG. 21 shows how a part of a road deck module 5 having two gutter elements 23 attached thereto could look like. FIG. 22 shows schematically by means of a dashed line and an arrow how water could flow from the road deck element 2 into gutter element 23 and finally via an outlet 24 into gutter element 23 and end up between the road deck elements 2 and the base plate 3. The gutter element is positioned next to the road, so that water flows over the road or can flow into the gutter element 23.

The following numbered paragraphs provide more disclosure of possible features of such a gutter element.

1 A gutter element having at least one inlet, at least one outlet and a reservoir having a bottom, the gutter element being configured for having in use relative to the direction of gravity the at least one inlet at an upper part of the gutter element, the bottom at a lower part of the gutter element, and the at least one outlet in between the bottom and the at least one inlet.

2 A gutter element according to para. 1, wherein the at least one inlet comprises a number of inlet openings, and the at least one outlet comprises a number of outlet openings.

3 A gutter element according to para. 2, wherein each of the outlet openings is smaller than the largest inlet opening.

4 A gutter element according to para. 1, 2, or 3, wherein the inlet openings are spatially separated from each other in a first pattern that resembles a line.

5 A gutter element according to para. 4, wherein pairs of the inlet openings are in the line at regular distances from other pairs of the inlet openings.

6 A gutter element according to para. 5, wherein each of the regular distances correspond to the length of a pair of the inlet openings.

7 A gutter element according to any one of para's 2-6, wherein each inlet opening has a maximum width of about 15 mm.

8 A gutter element according to any one of para's 2-7, wherein each inlet opening has a maximum length of about 35 mm.

9 A gutter element according to any one of para's 2-8, insofar dependent on para's 4, wherein each inlet opening has its length direction corresponding with the direction of the line.

10 A gutter element according to any of para's 2-9, wherein the outlet openings each have a maximum diameter that is smaller than a smallest dimension of each of the inlet openings.

11 A gutter element according to para 10, wherein each outlet opening has a maximum diameter of 14 mm.

12 A gutter element according to any of para's 2-11, wherein the outlet openings are grouped in groups of outlet openings, wherein the groups are spatially separated from each other.

13 A gutter element according to para 12, wherein the system is provided with at least one block-shaped protrusions and one of the groups of outlet openings is provided in a protruding surface of one of the block-shaped protrusions.

14 A gutter element according to para 12 or 13, wherein the at least one block-shaped protrusions is in use suitable for protruding between two columns of an infiltration system.

15 A gutter element according to para 13 of 14 wherein each of the block-shaped protrusions is provided with side connectors for adopting a connected condition in which the block-shaped protrusion is connected to the columns between which it is placed.

16 A gutter element according to any of the previous para's wherein the at least one inlet opening faces water that follows the direction of gravity.

17 A gutter element according to any of claims the previous para's wherein the at least one outlet opening extends parallel to the direction of gravity.

18 A gutter element according to any of the previous para's, wherein the at least one outlet allows for more flow of water than the at least one inlet.

19 A gutter element according to any one of the previous para's, wherein within the gutter element the bottom is concave for easy cleaning.

20 A gutter element according to any one of the previous para's, wherein the bottom is on the outside provided with bottom-connectors for adopting a connected condition in which the bottom is connected to an infiltration unit onto which it is placed.

21 A gutter element according to para 20, wherein the bottom-connectors allow for placement of the bottom onto a bottom part of an infiltration unit and therewith establishing a point of contact, and for then using the point of contact as a pivotal point for rotating the gutter element in a connected condition.

22 A gutter element according to para 20, wherein the gutter element extends significantly more in a longitudinal direction as compared to a transverse direction, wherein the longitudinal direction and the transverse direction are each in an imaginary plane that is normal to the direction of gravity.

23 A gutter element according to any one of the preceding para's, wherein the gutter element is connectable to an identical gutter element, so that the reservoir extends in a longitudinal direction.

24 A gutter element according to para 20, wherein each gutter element is provided with sleeve and spigot for connection to another gutter element.

25 A gutter element according to any one of the preceding para's, wherein the gutter element is provided with a possibility for connecting to an accessible gully, so that with a hose entering that gutter element from that gully the gutter element can internally be cleaned.

Figure 23:
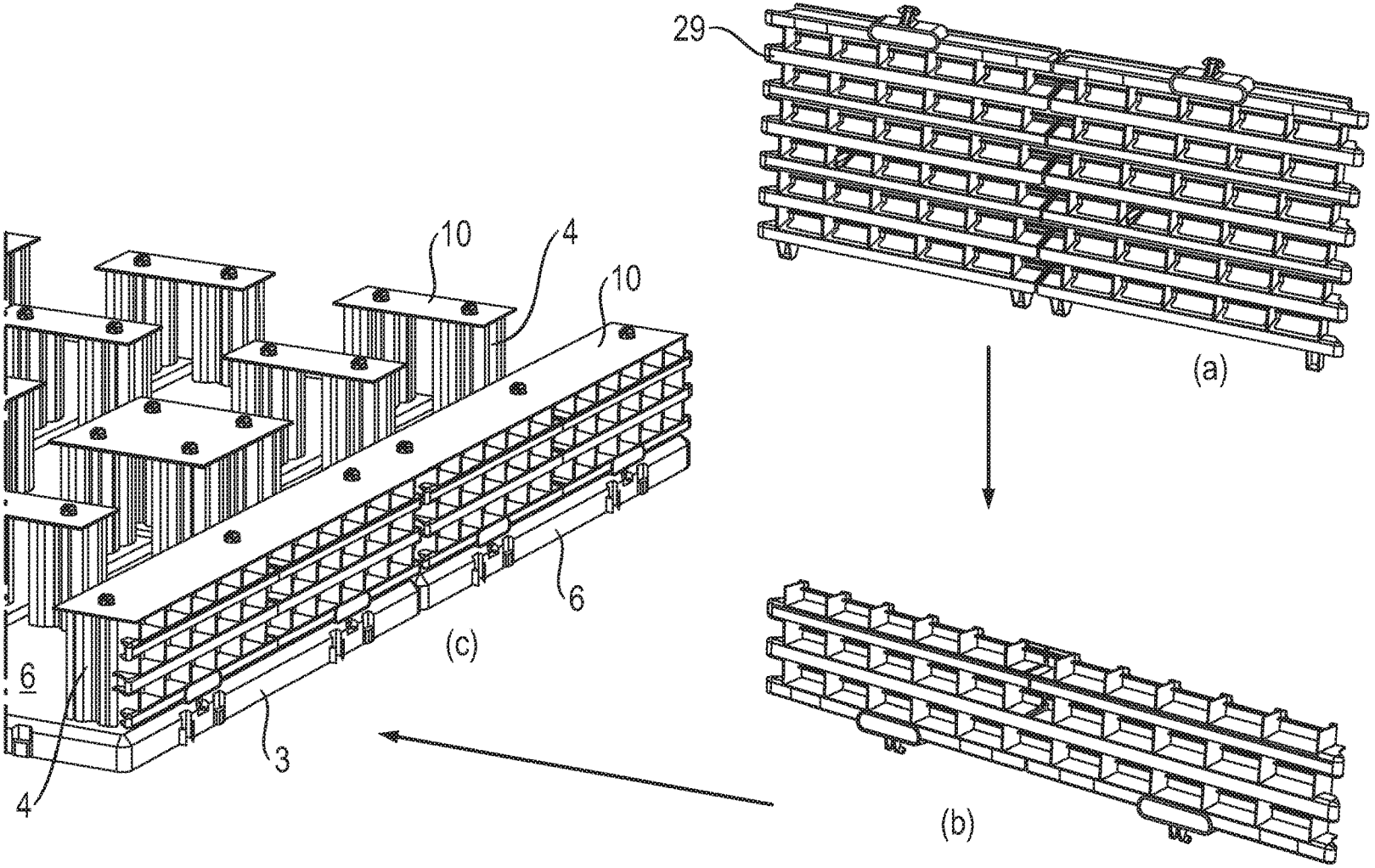
FIG. 23 shows side panels as part of an embodiment of a system according to the present disclosure.

For the sake of completeness, FIG. 23 shows a possible partly open side panel 29, as also used for Q-Bic+ modules as part of the storm water management (and is also described in WO 2016/042141 A1) which can equally be connected to a side of a road deck module 5. The side panel 29 is in part (a) of FIG. 23 shown as provided for use with the Q-Bic+ modules as part of the storm water management. In part (b) of FIG. 23 the panel is turned upside down and shortened. In part (c) of FIG. 23 the panel is shown as attached to support structures 6. The panel provides a good support frame against which a geotextile material can be placed for blocking sand moving into the tunnel 7, whilst water can freely pass that textile material and the panel. Also other structures that are in an assembled condition of the system formed or placed between road deck elements 2 and that allow for a flow of water therethrough may be a form of a slit-sized interruption of the road across the road.

Figure 24:
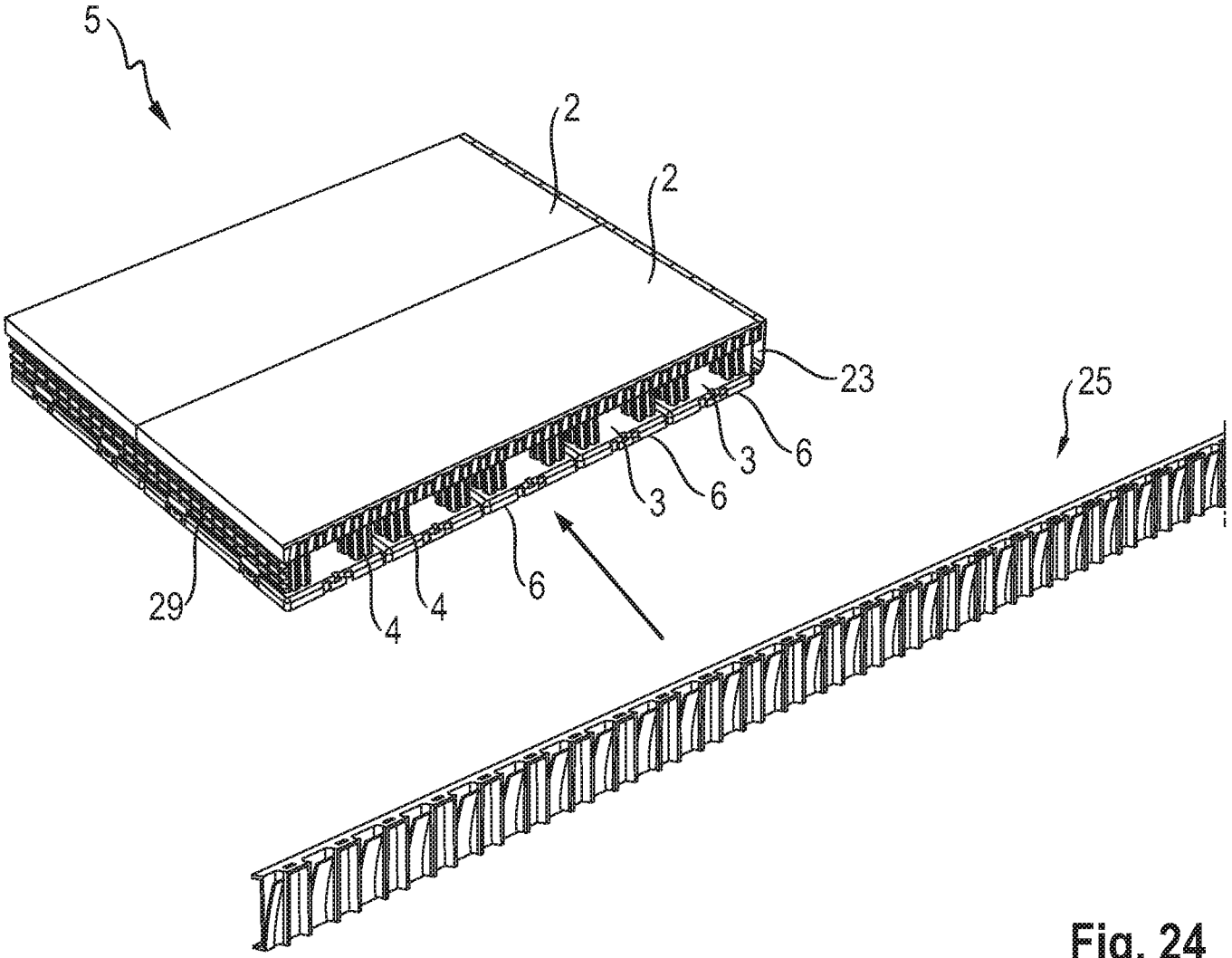
FIG. 24 shows a spacer as part of a road module according to embodiments of the present disclosure.
Figure 26:
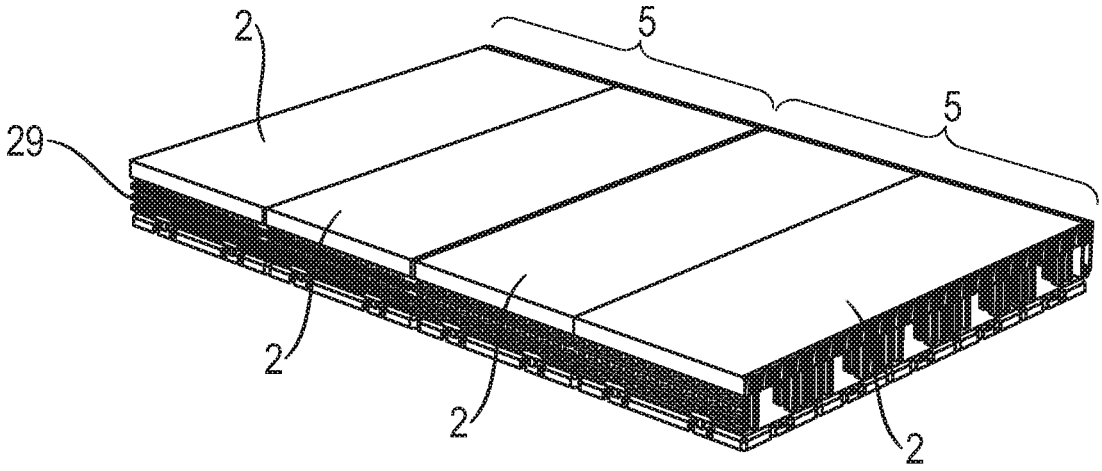
FIG. 26 shows a formation of a road in an embodiment of a method and an embodiment of a system according to the present disclosure.
Figure 25:
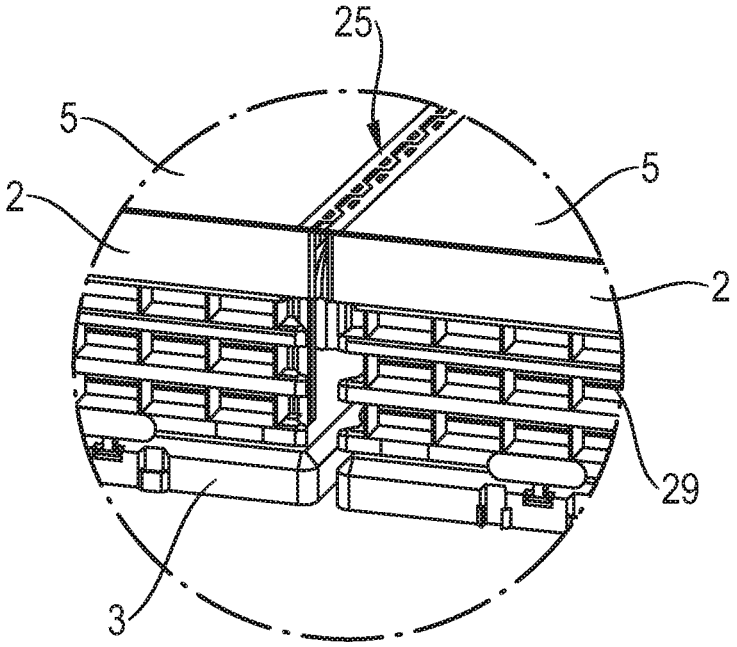
FIG. 25 shows a detailed visualization of use of a spacer shown in FIG. 24 in road modules as connected in embodiments of the present disclosure.
Figure 27:
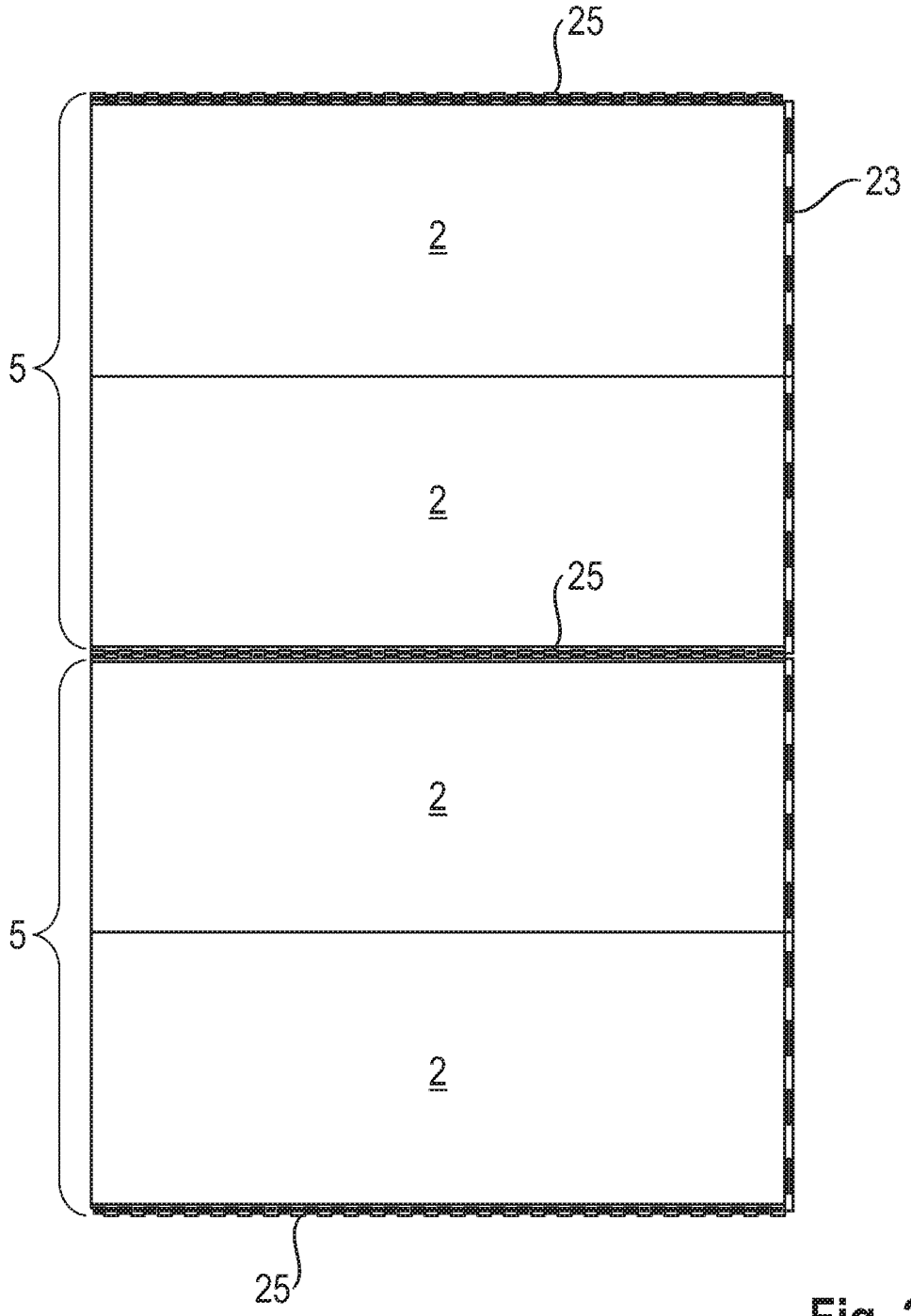
FIG. 27 shows an embodiment of a system as assembled and/or a result of an embodiment of a method for assembling a road according to the present disclosures.

Road deck modules 5 need to be connected to each other, preferably in a way that some restricted movement between the adjacent road deck modules 5 remains possible without disconnecting the adjacent road deck modules 5. For this purpose, use may be made of a spacer structure 25 as shown in FIG. 24, as further described in Dutch patent application NL 1042777, as well as tin PCT/EP2019/055375, incorporated herein by reference. FIG. 25 shows a more detailed view at a point where both road deck modules 5 are connected to each other to form a more extended road as shown in FIG. 26. A top view is shown in FIG. 27. The spacer structure can be seen as a form of a slit-sized interruption of the road across the road.

The following numbered paragraphs provide more disclosure of possible features of such a spacer structure.

1. A spacer-structure for fixation to a construction element, for maintaining a relative distance to another construction element, and for restricting at the maintained distance a movement about a position that is relative to another construction element, the spacer-structure having a structure that:

a) provides resiliency and generates a force for enhancing a distance relative to another nearby construction element when distance to that other construction element is reduced to a predetermined distance, and b) provides restriction of a movement of the structure in at least one direction that is different from the direction of predetermined distance.

2. A spacer-structure according to para, 1, wherein the structure comprises a resilient element.

3. A spacer-structure according to para. 1 and/or 2, wherein the structure comprises a restrictor for restricting the movement.

4. A spacer-structure according to para. 2 and 3, wherein the restrictor and the resilient element are spatially separated different elements of the structure, or wherein the restrictor and the resilient element are directly connected to each other and each embodied in one and the same single element of the structure.

5. A spacer-structure according to any one of the previous para's 3 or 4, wherein the restrictor is provided on the resilient element.

6. A spacer-structure according to par.a 5, wherein the restrictor is provided with an abutment surface for abutting a part of another construction element, and wherein the abutment surface is provided with a suction cup or a high-friction surface for firmly fixing the restrictor relative to another construction element whilst abutting that other construction element.

7. A spacer-structure according to any one of the previous para's as far as dependent on each of claims 2 and 3, wherein the structure is provided with at least one resilient element and at least one restrictor which are each spatially separated different parts of the structure.

8. A spacer-structure according to para. 7, wherein the structure is provided with a plurality of resilient elements and a plurality of restrictors.

9. A spacer-structure according to para. 8, wherein the resilient elements and the restrictors have positions in the structure which alternate each other along a dimension of the structure.

10. A spacer-structure according to any one of the previous para's, wherein the structure is fixed or fixable to a slab-shaped construction element having two main surfaces and a rim between the two main surfaces, wherein the structure is positioned or positionable at the rim for maintaining a relative distance to a rim of an adjacent slab-shaped construction element, and for reducing at the maintained distance a movement of the rim about a position that is relative to a rim of an adjacent slab-shaped construction element.

11. A spacer-structure according to any one of para's 2-10, wherein at least one of the resilient elements is pawl-shaped, and wherein preferably each resilient element is pawl-shaped.
12. A spacer-structure according to para. 10 and 11, wherein the resilient element has a free end at or close to a part of the structure that is in use of the structure at the rim at or close to one of the main surfaces.
13. A spacer-structure according to para. 2 and 12, wherein the free end is at the predetermined distance.
14. A spacer-structure according to para. 12, wherein the free end is a trailing end of the pawl-shaped element for placing the slab-shaped construction element adjacent to an end-positioned other slab-shaped construction element such that the trailing end is a part of the structure that is in time only toward the end of the placement adjacent to the end-positioned other slab-shaped construction element, as opposed to a part of the resilient element that is away from the free end and that is in time already at the beginning of the placement adjacent to the end-positioned other slab-shaped construction element.
15. A spacer-structure according to any one of para's 3-14, and according to para. 10, wherein the restrictor is designed for blocking movement of a free end of a pawl-shaped resilient element of a structure that is fixed to a rim of an adjacent slab-shaped construction element.
16. A spacer-structure according to para. 15, wherein the blocking element is a trailing end of the structure for placing the slab-shaped construction element adjacent to another already end-positioned slab-shaped construction element such that the trailing end is a part of the structure that is in time only toward the end of the placement adjacent to the other slab-shaped construction element, as opposed to a part of the structure that is away from the trailing end and that is in time already at the beginning of the placement adjacent to the end-positioned other slab-shaped construction element.
17. A spacer-structure according to any one of the previous para's, wherein the spacer-structure is one of the spacer-structures of an assembly having at least two of such spacers.
18. A spacer-structure according to para. 17, wherein the structure of each spacer-structure is provided with a plurality of resilient elements and a plurality of restrictors for restricting the movement, wherein the resilient elements and the restrictors of a respective structure alternate each other in a longitudinal direction of that structure.
19. A spacer-structure according to para. 17 or 18, wherein the structure of each spacer-structure is such that it allows for positioning the structure in a mating condition with the structure of another spacer-structure of the assembly.
20. A spacer-structure according to para. 19, wherein in the mating condition, the resilient element of the structure of one spacer-structure is opposite and interacting with the restrictor of the structure of another spacer-structure of the assembly.
21. A spacer-structure according to para. 20, wherein the structure is provided with a guiding track and with a counter track for interacting with the guiding track, such that on bringing the structure of one spacer into the mating position with the structure of another spacer, the structure first can be put under an angle relative to the other structure and be put in contact, to then let the counter track interact with the guiding track for reaching the mating condition.
22. A spacer-structure according to any one of the para's 19-21, wherein the structure is such that in the mating position the structure of one of the spacer-structures is locked into the mating position with the structure of another one of the spacer-structures.
23. A spacer-structure according to any one of the para's 19-22, wherein the structure is such that in the mating position the structure is in a mechanically releasable condition.
24. A spacer-structure according to any one of the para's 19-23, wherein the structure is provided with a plate-shaped element that in the mating condition extends from a trailing end of the structure and that in the mating condition at least to an extent covers a gap formed by distance between the mating structures.
25. A spacer-structure according to any one of the para's 19-23, wherein the plate-shaped element has an outer surface, and wherein in the mating condition a restricted movement is possible parallel to the outer surface.
26. A spacer-structure according to para. 25, wherein in the mating condition, the outer surfaces of the plate-shaped elements as part of the mating structures remain in the same plane.
27. A spacer-structure according to para. 10, wherein the structure is fixed to the slab-shaped construction element.
28. A spacer-structure according to any one of the previous para's, wherein the slab-shaped construction element is one of a concrete slab, a wall panel, a floatable plastic element, an infiltration unit, a road-deck element.

Figure 28:
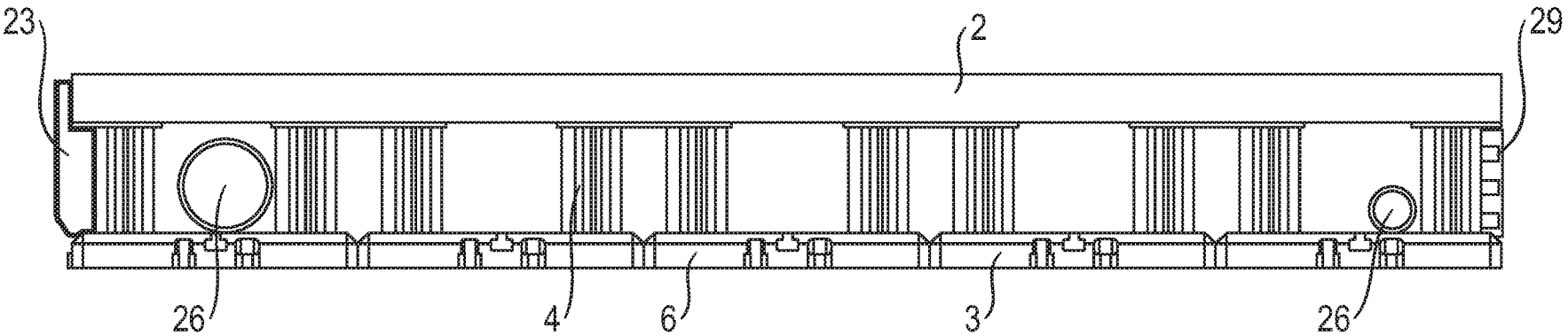
FIG. 28 shows a view in a direction of the road direction through a road as assembled using an embodiment of a system and/or a method according to the present disclosure.

FIG. 28 shows how further infrastructural elements such as pipes 26 may have a position within the system as assembled and usable as road.

Finally, it is pointed out that additionally or alternatively in an embodiment the road deck element may have an uppermost surface onto which rainwater may fall and which includes a shallow angle with a horizontal, the direction of gravity of course being perpendicular to the horizontal. The angle included may be in a range of 1° to 5°.

Figure 29:
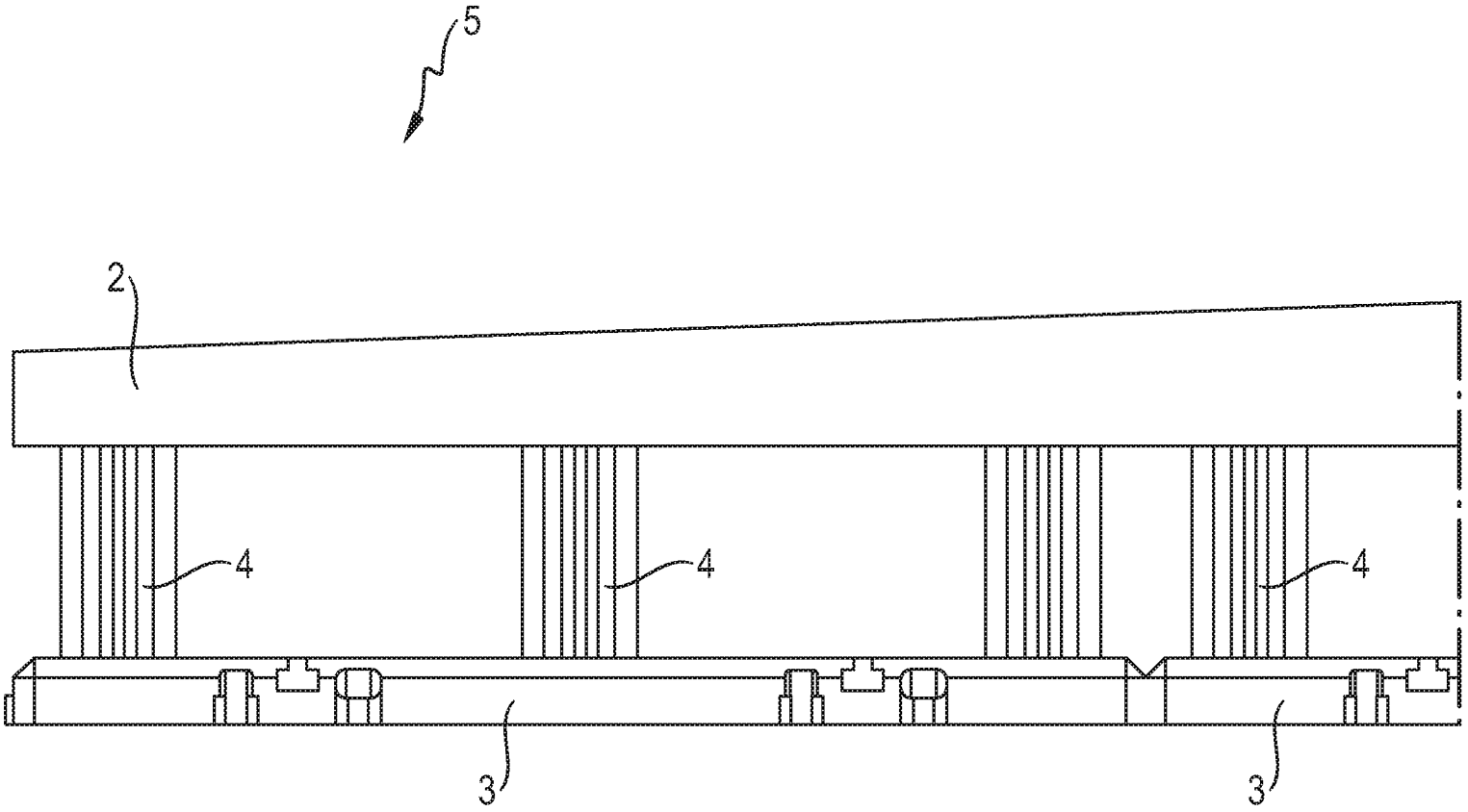
FIG. 29 shows a view in a direction of the road direction through a road as assembled using an embodiment of a system and/or a method according to the present disclosure, in which the road deck element has the shape of a trapezoid.

Advantageously, the support structure can be such that the columns are parallel to the direction of gravity, so that such a road deck element is still optimally supported, whilst still allowing water to flow away over the road deck due to the shallow angle. FIG. 29 depicts a part of a road module 5, having such a road deck element. The uppermost surface clearly allows for rainwater to flow over the road deck to a position next to the road.

The angle included by uppermost surface 17 and the bottom surface 19 of road deck element 2 is shown to illustrate the principle but does not necessarily correspond to the angle that may be used in practice.

In general, such a road deck may have the shape of a trapezoid. A cross-section, in a view as shown in FIG. 29, has the shape of a trapezium.

Within this disclosure, road is defined as a surface that is put in place for supporting traffic. It is possible that two are put parallel to each other and that one of the two roads is intended for traffic in one direction and the other one of the two roads is intended for traffic in the opposite direction. It is possible that one or more gutter elements are placed parallel to and in between these two roads.

The following will be directed to a description of a method of assembling a road. After the description as presented above, it is believed that the disclosure is further for a skilled person not in need of a very detailed description of a method for assembling a road, and as a result thereof the following section is kept relatively short.

The method comprises providing a plurality of plastic support structures 6 and a plurality of road deck elements 2. Each of the support structures 6 comprises a base plate 3 and at least one column 4. The method further comprises connecting at least one of the road deck elements 2 with at least one of the plastic support structures 6 so that a road module 5 is formed having at least one road deck element 2 and at least one plastic support structure 6. The method further comprises connecting adjacently placed plastic support structures 6 and/or adjacently placed road deck elements 2. In more detail, the method may comprise placing the support structures 6 adjacent each other such that the support structures 6 have, relative to the direction of gravity, the base plate 3 at a relatively low position and each of the at least one column 4 extending upwardly from a base plate 3. The method may further comprise placing the plurality of road deck elements 2 adjacent to each other such that the road deck elements 2 are supported by the adjacently placed support structure 6 and a road deck is formed by the adjacently placed road deck elements 2 and supported by the columns 4. Reference is made to FIG. 13 and to FIGS. 25-27.

Although in the drawings use is made of so-called carrier plates, or connection plates 10, it is also possible that the road deck elements are directly supported by the columns 4. As shown in FIG. 25-27 connecting adjacently placed plastic support structures and/or adjacently placed road deck elements 2 may comprise connecting adjacent placed road modules 5. In the method shown in the figures, each road module 5 is seen to comprise ten support structures 6 and two road deck elements 2. However, a skilled person will realize that in principle each combination is possible. Each road module 5 comprises at least one road deck element 2.

The comments made above about the carrier plate/connector plate or in terms of their use and function equally apply to the method.

We point out more specifically that although generally speaking the method may comprise connecting road modules 5 with each other, it is not inconceivable that first a large number of adjacently placed support structures 6 are connected, therewith providing a footprint for at least a main part of the entire road. As a later step then the road deck elements 2 could be positioned on top of the columns 4, with or without carrier plates (connector plates 10) in between. In any case, ultimately road modules 5 as lined up and connected up will lead to the formation of at least a part of a road 1.

One of the two main ways of assembling a road is thus first to assemble road deck modules 5 to then align these and connect these. The road deck modules can be made at an assembly site relatively far away from the track where the road needs to end up. The road deck modules can be easily transported. The other one of the two main ways of assembling a road entails the separate placement of the support structures, i.e. to connect these and to establish at a track where the road needs to be. Then, in a later step, the road deck elements 2 could be placed so as to form the entire road deck of the road. In between these steps, pipe and/or cables etc. may be laid between the columns of the support structures. It is shown in the drawing that the road deck elements 2 are each time supported by one support structure 6. However, it is also conceivable that a road deck element 2 is partly supported by one support structure and partly by another support structure.

The method may comprise connecting the support structure 6 and road deck elements 2 such that in an assembled condition at least one tunnel 7 is formed between the road decks 2 and the base plates 3. In the assembled condition a road 1 is formed and the at least one tunnel 7 extends across at least one entire dimension of the road 1. More particularly, the method is free from a step of applying to each of the support structures along the entire circumference of the respective base plate 3 upwardly extending wall members in a direction parallel to the at least one column 4. However, as explained above, a gutter element 23 and a partly open side panel 24 may be placed at certain sides without blocking the tunnel 7 in the direction of the road.

The plurality of plastic support structures 6 as provided could entail a plurality of plastic support structures having for each base plate 3 the columns 4 seamlessly connected with the base plate 3. However, it is also possible that columns 4 are connectable to base plate 3. It is possible that for that purpose at least one and preferably each support structure 6 has a column with a first end 8 that is connectable with the base plate 3. Columns 4 may have a second end 9 that is connectable, or that is connected with a carrier plate 10 for carrying in an assembled condition of the system one or more adjacently placed road deck elements 2. The method may comprise connecting, or just placing, the carrier plate with at least two columns 4.

Each column may have a second end 9 and each road deck element 2 may be provided such that it is connectable to a number of the second ends 9. The method may then comprise connecting at least one road deck element 2 to a number of second ends.

The road deck elements 2 may each be provided with an outer layer that is usable as a road surface. The road surface may comprise a ceramic material for providing a friction enhancing surface and/or for providing a wear-resistance/t surface.

The road deck elements 2 may be provided in a variety of ways. However, it is preferred to provide a plurality of road deck elements 2 which comprise a structure having a plate-shaped part as an upper deck level of the respective road deck element and a cell structured part as a lower deck level. The plate-shaped parts may form the uppermost deck level, i.e. may have a ceramic material for providing a friction enhancing surface and/or for providing wear-resistance.

The structure of the road deck element 2 may comprise a sandwich structure having the cell structured part between the plate shaped part that forms an upper deck level and a plate shaped part that is provided at a side of the cell structured part that is opposite the plate shaped part that forms the upper deck level. The cell structured part may comprise a honeycomb structure, such that each honeycomb has its axis directly towards the plate shaped part that forms an upper deck level of the respective road deck element. It is also possible that the road surface is provided with a suitable layer once the road has been built by assembling the system. For instance a coating may be applied or a layer may be hot-melted onto the road deck 2.

The plastic support structure 6 may at least partly be usable as a water attenuation or a water infiltration structure.

The method may further comprise providing a number of gutter elements. The method may comprise separately connecting the gutter elements to at least one of the road deck elements and/or to at least one of the support structures. However, it is not inconceivable that a number of the gutter elements are provided such that these are at least partly integrated in one of the support structures or in one of the road decks.

It is also possible that a side of the road deck module 5 that is opposite the side where the gutter element is provided, will be closed off by a panel. It is further possible to provide in a longitudinal direction of the road geotextile that is permeable to water but provides resistance to sand grains that may without the textile end up in the "tunnel". This textile is well-known in the art of building underground infrastructures for water management.

The road may be positioned so that water will always flow to a position next to it or to a slit-sized interruption of the road across the road. A skilled builder has no difficulty in ensuring that the road is perceived as water-levelled but still under a shallow angle that ensures that water does flow over the road away from the road. It is of course possible that the system is configured such that when the base plate is water-levelled, the road deck elements are such that rainwater predominantly flows away over the road to one or more positions next to the road and/or to a slot-sized interruption of the road across the road.

In such an embodiment the column may for instance have different lengths and the ends of the columns near the road decks may be under a shallow angle with the horizon. Ideally recyclate plastics are used.

When plastics were mentioned above, there may be the usual plastics, such as for instance PP, PE, PVC, etc. Ideally recyclate plastics are used. However, additionally or alternatively it is also possible to use trapezium shaped road deck elements, as discussed above.

It is further pointed out that although reference is made to WO 2016/042141 A1, the support structures may also be very different from that enclosure. To begin with, the columns are not necessarily cylindrical. Also cone-shaped columns are for instance suitable. It is further possible that for instance two truncated cones face each other with the smaller cross-section and form together a column. The base plate may equally have a structure that is very different from those disclosed in WO 2016/042141 A1. Suitable support structures may also be found in for instance WO 2100/042215 A1, DE 102009044412 A1, EP 3165687 A2, EP 2980328 A1 and EP 2463449 A1.

The slit-sized interruption of the road across the road may also comprise a grid, may be zig-zagged, or may be diagonally crossing the road, etc.

All such modifications are understood to fall within the framework of the present disclosure.

The invention claimed is:

1. A system for assembling a road, the system comprising a plurality of plastic support structures and a plurality of road deck elements, wherein each of the support structures comprises a base plate and at least one column extending, or for extending, upwardly from the base plate for supporting at least partly one of the road deck elements, each of the road deck elements being configured such that in an assembled and as road useable condition of the system rainwater predominantly flows away over the road to one or more positions next to the road, and/or to a slit-sized interruption of the road across the road, wherein the system comprises a number of gutter elements and wherein at least one of the gutter elements is at least partly integrated with, or connectable to, at least one of the columns, and can collect the water that flows away over the road to one or more positions next to the road, and/or to a slit-sized interruption of the road across the road.

2. A system according to claim 1, wherein the support structures and/or the road deck elements are connectable such that in an assembled condition at least one tunnel is formed between the road decks and the base plates, wherein in an assembled condition of the system a road is formed and the least one tunnel extends in a length dimension of the road.

3. A system according to claim 1, wherein at least a number of the support structures are free from having along the entire circumference of the base plate upwardly extending wall members extending in a direction parallel to the at least one column.

4. A system according to claim 1, wherein the system comprises a carrier plate that has a seamless connection with at least two columns, or that is connectable with at least two columns.

5. A system according to claim 1, wherein at least one of the plurality of support structures is at least partly usable as a water attenuation or water infiltration structure.

6. A system according to claim 1, wherein at least one and preferably each of the columns is provided with a connector part for connecting with at least a part of one of the road decks, so that the respective road deck is supported by at least one column.

7. A system according to claim 1, wherein at least one of the gutter elements is separately connectable to at least one of the road deck elements and/or to at least one of the support structures.

8. A system according to claim 1, wherein at least one of the gutter elements is at least partly integrated in at least one of the support structures and/or at least one of the road deck elements.

9. A system according to claim 1, wherein at least one of the plurality of road deck elements comprises plastic.

10. A system according to claim 1, wherein at least one of the plurality of road deck elements comprises fibers.

11. A system according to claim 1, wherein at least one of the road deck elements is a configured for placement as a single element directly on top of one or more adjacently placed support structures.

12. A system according to claim 1, wherein the plastic comprises recycled plastic.

13. A system according to claim 1, wherein the system only consists of a plurality of plastic support structures and a plurality of road deck elements or only consists of a plurality of plastic support structures, a plurality of road deck elements and a plurality of gutter elements.

14. A system according to claim 1, wherein each road deck element is provided with an outer layer that is usable as a road surface.

15. A system according to claim 14, wherein each road deck element is provided with a connection side that is opposite the outer layer and that is provided with connection structures which are each releasably connectable with one of the connector parts.

16. A system according to claim 1, wherein at least one of the plurality of road deck elements comprises a structure having a plate shaped part that forms in an assembled and as road useable condition an upper deck level of the respective road deck element, whereas the structure has a cell-structured part as a lower deck level.

17. A system according to claim 16, wherein the plate shaped part forms the upper most deck level.

18. A system according to claim 17, wherein the plate shaped part comprises a non-plastic, preferably a ceramic, material for providing a friction enhancing surface and/or for providing a wear resistant surface.

19. A system according to claim 16, wherein the structure comprises a sandwich structure, having the cell-structured part between the plate shaped part that forms an upper deck level and another plate shaped part that is provided at a side of the cell-structured part that is opposite the plate shaped that forms the upper deck level.

20. A system according to claim 16, wherein the cell structured part comprises a honeycomb structure, such that each honeycomb has its axis directed towards the plate shaped part that forms an upper deck level of the respective road deck element.

* * * * *